US005286911A

United States Patent [19]

Murata et al.

[11] Patent Number: 5,286,911

[45] Date of Patent: Feb. 15, 1994

[54] ELECTRONIC RUBBED-STRING INSTRUMENT

[75] Inventors: Yoshiyuki Murata, Tachikawa; Tatsuya Dejima, Fussa, both of Japan

[73] Assignee: Casio Computer Co., Ltd., Tokyo, Japan

[21] Appl. No.: 949,749

[22] Filed: Sep. 23, 1992

Related U.S. Application Data

[63] Continuation of Ser. No. 806,855, Dec. 9, 1991, abandoned, which is a continuation of Ser. No. 409,038, Sep. 18, 1989, abandoned.

[30] Foreign Application Priority Data

Sep. 20, 1988 [JP] Japan ..... 63-12331[U]
Nov. 30, 1988 [JP] Japan ..... 63-300960

[51] Int. Cl.[5] ..... G10D 1/02; G10H 1/34

[52] U.S. Cl. ..... 84/615; 84/626; 84/658; 84/687; 84/723; 84/743

[58] Field of Search ..... 84/615, 658, 687–690, 84/723, 735, 736, 741–743, 626, 734

[56] References Cited

U.S. PATENT DOCUMENTS

| | | | |
|---|---|---|---|
| 2,933,967 | 4/1960 | Riscol | 84/726 |
| 3,595,981 | 7/1971 | Hopping | 84/726 |
| 3,691,285 | 9/1972 | Larrison | 84/726 |
| 4,018,125 | 4/1977 | Nishimoto | 84/655 |
| 4,257,305 | 3/1981 | Friend et al. | 84/690 |
| 4,658,690 | 4/1981 | Aitken et al. | 84/629 |
| 4,730,530 | 3/1988 | Bonanno | 84/724 |
| 4,765,219 | 8/1988 | Alm | 84/726 |
| 4,781,097 | 11/1988 | Uchiyama et al. | 84/738 |
| 4,805,510 | 2/1989 | De Dianous | 84/723 |
| 4,875,400 | 10/1989 | Okuda et al. | 84/626 |
| 4,882,965 | 11/1989 | McClish | 84/726 |
| 4,919,032 | 4/1990 | Sakashita | 84/653 |
| 4,979,423 | 12/1990 | Watanabe | 84/690 |

FOREIGN PATENT DOCUMENTS

| | | |
|---|---|---|
| 53-46446 | 12/1978 | Japan . |
| 55-32849 | 3/1980 | Japan . |

*Primary Examiner*—William M. Shoop, Jr.
*Assistant Examiner*—Brian Sircus
*Attorney, Agent, or Firm*—Frishauf, Holtz, Goodman & Woodward

[57] ABSTRACT

An electronic rubbed-string instrument of a type which generates musical tones in response to rubbing operation of operation member across an instrument body or string in a similar way to a violin and a viola. When a part of instrument body is rubbed with an operating member, characteristics (e.g., tone color characteristics, pitch characteristics) of a musical tone to be generated are controlled in response to a speed of the operating member. Further, the characteristics of the musical tone are controlled in response to pressure applied to a part of the instrument body with the operating member. Furthermore, the characteristics of the musical tone are controlled in response to a direction in which the bow is moved across the strings.

4 Claims, 18 Drawing Sheets

| BOWING DATA | CONVERTED INITIAL DATA |
|---|---|
| 0 | 0 |
| 1 | 0 |
| 2 | 0 |
| 10 | 1 |
| 11 | 3 |
| 12 | 6 |
| 13 | 9 |
| 14 | 12 |
| 15 | 15 |
| 20 | 30 |
| 21 | 32 |
| 22 | 34 |
| 23 | 36 |
| 24 | 38 |
| 25 | 40 |

| BOWING DATA | CONVERTED INITIAL DATA |
|---|---|
| 81 | 93 |
| 82 | 94 |
| 83 | 95 |
| 84 | 96 |
| 85 | 97 |
| 86 | 98 |
| 87 | 99 |
| 88 | 100 |
| 120 | 124 |
| 121 | 124 |
| 122 | 125 |
| 123 | 125 |
| 124 | 126 |
| 125 | 126 |
| 126 | 127 |
| 127 | 127 |

FIG. 4

ELECTRONIC RUBBED-STRING INSTRUMENT

This application is a continuation of application Ser. No. 07/806,855, filed Dec. 9, 1991, which is a Continuation of Ser. No. 07/409,038, filed Sep. 18, 1989 both abandoned.

BACKGROUND OF THE INVENTION

1. Field of the Invention

The present invention relates to an electronic rubbed-string instrument and, more particularly, to an electronic rubbed-string instrument, such as a violin, a viola and a cello, which generates desired musical tones in response to rubbing operations or bowing operations performed by a player.

2. Description of the Related Art

In the field of electronic rubbed-string instruments, electronic musical instruments are well known in which rotary rods corresponding to strings and each provided at its one end with a generator are rotated in response to bowing operations, and musical tones having sound volume corresponding to the rotational speeds of the rod are generated. For example, an electronic musical instrument of this kind is described in Japanese Utility Model Kokai Sho 55-32849.

In the conventional electronic rubbed-string instruments, when a speed of a bow movement is increased and an analog bowing detection signal (output voltage) is gradually increased in response to the above speed, the sound volume of a musical tone can be gradually increased in proportion to the above signal increase.

However, in the above conventional electronic rubbed-string instruments, it is only possible to proportionally increase or decrease the sound volume of the musical tone, but, for example, when a bow is moved gradually fast, it is not possible to decrease the sound volume of the musical tone in inverse proportion to the bow-movement speed. The above conventional musical instruments have other drawback that when the bow-movement speed exceeds a predetermined level, it is impossible to rapidly increase the sound volume from a certain volume level. In addition, they have a further drawback that not only the sound volume of a musical tone to be generated but also its other musical characteristics such as tone color characteristic and pitch characteristic can not be appropriately changed.

The generators used in the above conventional electronic rubbed-string instruments do not respond well to the bow operation performed by the player. Therefore, for example, when the player operates the bow abruptly fast from the beginning, the generator does not rapidly raise the output level. For this reason, it is impossible in these musical instruments to generate from the beginning a musical tone having a large sound volume and also having an attack at the time of the commencement of a performance. As described above, the conventional electronic rubbed-string instruments have a drawback that in the instruments the bow operation performed by the player does not appropriately affect the sound volume of a musical tone to be generated. On the contrary to the above mentioned case, it may be proposed to use a generator having a fine and high responsibility. But if the generator having a high responsibility is employed in the musical instrument, the musical instrument will have another drawback that it generates an accidental and unnecessary tone, even when the bow is simply put on the strings for a bowing operation or when a wrong operation happens.

In a violin as one type of typical acoustic rubbed-string instruments, tone color of a musical tone to be generated is appropriately controlled by adjustment of the pressure applied to a string by use of a bow (bowing pressure). Meanwhile, in the above electronic rubbed-string instruments, it is impossible to change tone color of a musical tone to be generated by the adjustment of the bowing pressure. Therefore, in order to provide a performance similar to that given by typical acoustic rubbed-string instruments, the above electronic rubbed-string instruments are still imperfect in functions. Recently, an electronic rubbed-string instrument has been developed in which a bowing pressure detection sensor for detecting pressure applied to strings by use of a bow is provided on the bow adapted to be drawn across the strings. This electronic rubbed-string instrument is disclosed in U.S. Pat. No. 4,805,510.

However, when a musician plays the above electronic rubbed-string instrument, he has to use the bow which is provided with the bowing pressure detection sensor in order to detect the bow pressure applied to the strings. Accordingly, the musician can not use a rod-shaped bowing member instead of the bow adapted to be used with the typical violin and the like and a substitute for the bow, when he plays the above electronic rubbed-string instrument. Therefore, there is a disadvantage that the electronic rubbed-string instrument can not be played without any restriction. As described in U.S. Pat. No. 4,805,510, in the electronic rubbed-string instrument, a pressure signal detected by the bowing pressure detection section is only supplied to a frequency synthesizer, so that the tone color of a musical tone to be generated can not be controlled on the basis of the above pressure signal. Therefore, there is a disadvantage that with use of the above electronic rubbed-string instrument, effect similar to that provided by playing the typical acoustic rubbed-string instrument can not be obtained.

In the typical acoustic rubbed-string instrument such as a violin, characteristics of a musical tone to be generated can be changed in accordance with the bowing directions. For example, since the bowing speed and the bowing pressure applied to strings are different between when the bow is drawn across the strings in one direction and when the bow is drawn in the counter direction, sound volume characteristics of the musical tone to be generated are different.

However, the conventional electronic rubbed-string instruments have a drawback that characteristics of a musical tone to be generated can not be made different in accordance with the bowing directions.

Further, in the typical acoustic rubbed string instrument such as a violin, tone color characteristics of a musical tone to be generated are made different in accordance with contacting positions where an expanded string is touched with the bow. For example, when the bow is drawn across the strings nearby a fingerboard, a musical tone having soft tone color is generated and on the contrary, when the bow is drawn across the strings nearby a bridge, a musical tone having hard tone color is generated.

However, the conventional electronic rubbed-string instruments have a drawback that the tone color of the musical tone can not be changed in accordance with contact positions where the string is touched with the bow.

OBJECTS OF THE INVENTION

The present invention has been intended to solve the prior art drawbacks and disadvantages described above, and it has an object of providing an electronic rubbed-string instrument, which permits a rubbing-operation state produced by a player to be adequately reflected on a characteristic of a musical tone (a tone parameter of a musical tone) to be generated, e.g., a tone level or tone color contents.

Another object of the invention is to provide an electronic rubbed-string instrument, which can prevent generation of an unnecessary tone in response to a noise output, if any, produced due to a wrong rubbing operation or produced when the operation member (bow) is put on a part of an instrument body or the strings irrelevantly to musical performance.

A further object of the invention is to provide an electronic rubbed-string instrument, with which, when the bow is drawn slowly at its commencement and is subsequently done gradually fast, a tone parameter of a tone to be generated can be controlled in response to the rubbing operation speed.

A still further object of the invention is to provide an electronic rubbed-string instrument, which, without using of a specific bow or a specific operation member, is capable of detecting pressure applied to a part of the instrument body with use of the operating member.

A yet further object of the invention is to provide an electronic rubbed-string instrument in which characteristics of a musical tone to be generated are controlled in accordance with pressure applied to a part of the instrument body with use of the operating member.

A yet another object of the invention is to provide an electronic rubbed-string instrument, in which characteristics of a musical tone to be generated can be controlled in accordance with the direction of operation of the operating member.

According to an embodiment of the invention there is provided an electronic rubbed-string instrument, which comprises operation-state detection means for detecting successively for a predetermined number of times a rubbing operation state in which a part of an instrument body is rubbed with an operating member and for outputting detection signals corresponding to the detected rubbing operation state; value detection means for finding out whether an output value of the detection signal output from said operation-state detection means exceeds a predetermined set value; response-data generation means for generating a response data corresponding to a variation state in the detection signals in a predetermined time duration from the time when said value detection means has found out that the output value of one of the detection signals exceeds the predetermined set value; and designation means for designating a characteristic of a musical tone to be generated in accordance with the response data generated by said response data generation means.

The above mentioned "a part of an instrument body" may be strings expanded over the instrument body, a rotating member mounted on the instrument body at a position facing said strings, or a projecting portion on the instrument body. The above "operating member" is not always a bow but may be a stick member or rod-type member and the like. The expression "rubbing operation state in which a part of an instrument body is rubbed" includes a rotating operation state in which a rotating member rotatably mounted on the instrument body is caused to rotate and a rubbing operation state or bowing operation state in which the strings expanded over the instrument body are directly rubbed as well as a state in which a part of the instrument body is directly rubbed. Further, the expression "a variation state in the detection signals in a predetermined time duration" includes a difference of output value of the detection signal detected in a time interval between the time when the output value of the detection signal exceeds the predetermined set value and the time when the output value of the detection signal reaches a set value other than the above predetermined set value and a variation rate state in said time interval. In this case, when the above difference of output value of the detection signal or variation rate state in said time interval is large, it is indicated that the detection signal varies abruptly and on the contrary when the above difference of output value of the detection signal or variation rate state in said time interval is small, this indicates that the detection signal varies slowly.

In one embodiment of the invention, characteristics of a musical tone to be generated, such as a tone volume characteristic, a tone color characteristic and a pitch characteristic, can be designated in accordance with response data generated by response-data generation means. When the operating member is moved gradually fast across the string, it is possible to gradually decrease the tone volume of the musical tone being generated in inverse proportion to the operation speed of the operating member. When the operation speed of the operating member exceeds a predetermined speed, it is possible to abruptly increase the tone volume of the musical tone from the time when the above operation speed of the operating member exceeds the predetermined speed. Further, it is possible to generate musical tones with tone colors successively selected in response to the operation speeds of the operating member.

According to other embodiment of the invention, there is provided an electronic rubbed-string instrument, which comprises operation-state detection means for detecting successively for a predetermined number of times a rubbing operation state in which a part of an instrument body is rubbed with an operating member and for outputting detection signals corresponding to the detected rubbing operation state; value detection means for finding out whether an output value of the detection signals output from said operation-state detection means exceeds a predetermined set value; first response-data generation means for generating a first response data corresponding to a variation state in the direction signals output from said operation-state detection means in predetermined time duration from the time when said value detection means has found out that the output value of one of the detection signals exceeds the predetermined set value; first designation means for designating a characteristic of a musical tone to be generated in accordance with the first response data generated by said first response data generation means; second response-data generation means for generating second response-data corresponding to the output values of the detection signals successively output from said operation-state detection means after the characteristic of a musical tone to be generated has been designated by said first designation means; and second designation means for instructing to successively control a characteristic of a musical tone being generated, on the basis of the second response data generated by said second response-data generation means.

In this embodiment of the invention, a characteristic of a musical tone to be generated is designated by first designation means in accordance with first response data generated by first response-data generation means. Further a characteristic of a musical tone being generated is designated by second designation means in accordance with second response data generated by second response-data generation means. Therefore, the characteristic of the musical tone can be surely controlled in response to the rubbing operation state of the operating member not only at the commencement of generation of the musical tone but also after generation of the same.

According to a further embodiment of the invention, there is provided an electronic rubbed-string instrument, which comprises operation-state detection means for detecting successively for a predetermined number of times a rubbing operation state in which a part of an instrument body is rubbed with a operating member and for successively outputting state-detection signals corresponding to the detected rubbing operation state; instruction means for instructing to generate a musical tone on the basis of the state-detection signals output from the operation-state detection means; pressure-detection means mounted on said instrument body for detecting pressure applied with said operating member and for successively outputting pressure-detection signals corresponding to the detected pressure state; and designation means for designating a characteristic of a musical tone to be generated by the instruction of said instruction means on the basis of the pressure detection signals detected by said pressure-detection means.

In the present embodiment of the invention, without use of a specific bow having pressure-detection means, the pressure applied to a part of the instrument body with use of a operating member can be detected. Therefore, the characteristic of the musical tone to be generated can be designated in response to the detected pressure state.

According to further another embodiment of the invention, there is provided an electrical rubbed-string instrument, which comprises operation-state detection means for detecting successively for a predetermined number of times a rubbing operation state in which a part of an instrument body is rubbed with a operating member and for successively outputting detection signals corresponding to the detected rubbing operation state for a predetermined number of times; value detection means for finding out whether an output value of the detection signal output from said operation-state detection means exceeds a predetermined set value; time-counting means for counting time duration between a first time when an output value of the detection signal output from said rubbing-state detection means exceeds a predetermined set value and a second time when predetermined time duration lapses from said first time; first response-data generation means for generating data having a predetermined value as a first response data, regardless of an output value of the detection signal output at the time which said time counting means counts first designation means for designating a characteristic of a musical tone to be generated in accordance with the first response data generated by said first response-data generation means; second response-data generation means for successively generating second response-data corresponding to the output values of the detection signals successively output from said operation-state detection means after the generation of the musical tone having the characteristic designated by said first designation means; and second designation means for successively designating characteristics of the musical tone in accordance with the second response data generated by said second response-data generation means, after said musical tone having the characteristic designated by said first designation means has been generated.

In the present embodiment of the invention, when the operation speed of the operating member is gradually increased, data having a predetermined value is generated as the first response-data regardless of the output value of the detection signal detected by the operation-state detection means. Therefore, even when the operation speed of the operating member is low at the beginning of the operation and is gradually increased, the characteristic (e.g., tone volume) of the musical tone to be generated can be appropriately controlled.

According to a yet further embodiment of the invention, there is provided an electronic rubbed-string instrument, which comprises operation-state detection means for detecting successively for a predetermined number of times a rubbing operation state in which a part of the instrument body is rubbed with a operating member and for successively outputting detection signals corresponding to the detected rubbing operation state; time-counting means for counting time duration between a first time when an output value of the detection signal output from said operation-state detection means exceeds a predetermined set value and a second time when predetermined time duration lapses from the above first time; response-data generation means for generating response data corresponding to the output value of the detection signal output at the above second time counted by said time counting means; and designation means for designating a characteristic of a musical tone to be generated, in accordance with the response data generated by said response-data generation means.

In the above embodiment of the invention, the characteristic of the musical tone to be generated is designated in accordance with the response data corresponding to the output value of the detection signal detected at the second time which is counted by the time counting means. Therefore, when the operating member is simply put on a part of the instrument body or when noise signal irrelevant to a musical performance is generated, it is possible to prevent generation of an unnecessary tone.

According to a yet another embodiment of the invention, there is provided an electronic rubbed-string instrument, which comprises operation-state detection means for detecting successively for a predetermined number of times a rubbing operation state in which a part of an instrument body is rubbed with a operating member and for outputting state-detection signals corresponding to the detected rubbing operation state; first designation means for instructing to generate a predetermined musical tone on the basis of the state-detection signals output from said operation-state detection means; direction detection means for detecting a direction in which a part of the instrument body is rubbed with said bar-type operating member and for outputting a direction detection signal corresponding to the detected direction; and second designation means for designating a characteristic of a musical tone which is to be generated by the instruction of said first designation means, on the basis of the direction detection signal output from said direction detection means.

In the above embodiment of the invention, the characteristics (e.g., a tone color characteristic, effect characteristics and a pitch characteristic) of the musical tone to be generated are designated on the basis of the direction signal detected by the direction detection means. Therefore, it is possible to provide, with use of the electronic rubbed-string instrument to which the present invention is applied, performance effects similar to those given with use of typical acoustic musical instruments.

According to a further embodiment of the invention, there is provided an electronic rubbed-string instrument, which comprises operation-state detection means for detecting successively for a predetermined number of times a rubbing operation state in which a part of an instrument body is rubbed with a rod-type operating member and for successively outputting detection signals corresponding to the detected rubbing operation state; value detection means for finding out whether an output value of the detection signal output from said operation-state detection means exceeds a predetermined set value; instruction means for instructing to start generation of a musical tone provided that said value detection means has found out that the output value of the detection signal exceeds the predetermined set value; and characteristic designation means for successively designating characteristics of the musical tone to be generated, in accordance with the detection signals successively output from said operation-state detection means, after said instruction means has instructed to start generation of the musical tone.

In the present embodiment, the characteristics (e.g., a tone volume characteristic and a tone color characteristic) of the musical tone to be generated can be successively designated in accordance with the detection signals successively detected by the operation-state detection means. Therefore, generation of musical tones can be successively controlled, that have tone color and tone volume corresponding to the state in which the operating member is operated.

BRIEF DESCRIPTION OF THE DRAWINGS

FIG. 4 is a view showing an example of conversion contents of a bowing data/initial data conversion table;

DESCRIPTION OF THE PREFERRED EMBODIMENTS

Now, an embodiment of the invention will be described with reference to the drawings.

OVERALL OUTER STRUCTURE

Figure 1A:
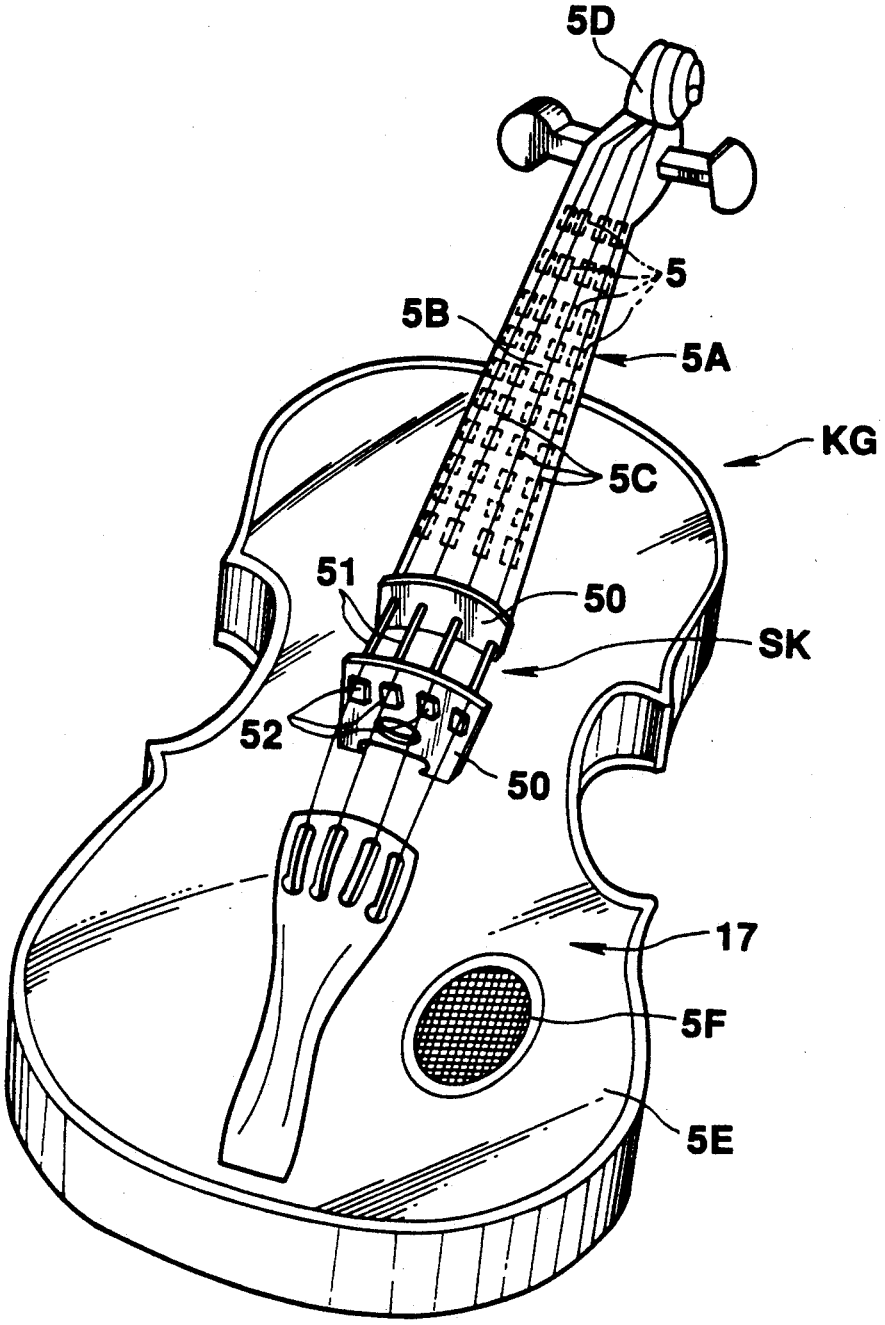
FIG. 1A is a perspective view showing an embodiment of an electronic rubbed-string instrument according to the present invention.

FIG. 1A is a perspective view showing an external structure of an embodiment of the electronic rubbed string instrument.

Figure 1B:
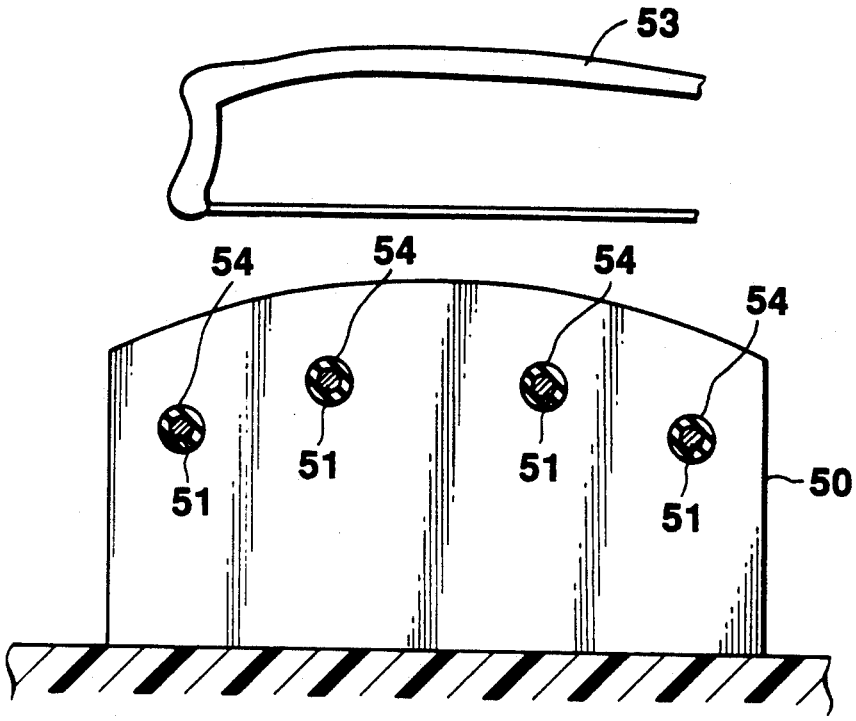
FIG. 1B is a cross-sectional view showing a operation member (bow) and bowing operation detection sections.
Figure 1C:
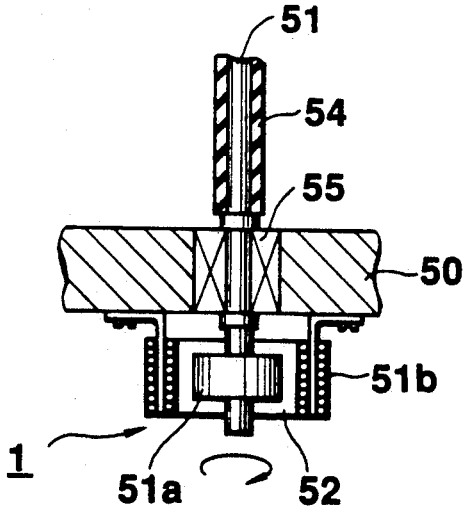
FIG. 1C is a partial cross-sectional view of a rotatable shaft and a generator connected thereto.

As is shown, a rubbed string instrument body KG having a shape like a violin is provided with a bowing operation detection section SK, pitch-setting switches 5 and a sound system 17. The bowing operation detection section SK is composed of four rotatable shafts 51 extended between a pair of support members 50 and four generators 52 each provided at one end of each rotatable shaft 51. As is shown in FIG. 1B, the rotatable shafts 51 are coated with a tubular type rubbing member 54 such as a gum tube such that when the rotatable shafts 51 are caused to rotate or rubbed with a bow 53, they rotate without failure in response to the bow movement. The generators 52 serve as bowing operation sensors 1. The bowing operation sensor 1 is composed of a rotator (a permanent magnet) **51*a* secured to the rotatable shaft 51 and a field coil 51*b* provided at the outside of the rotator 51*a*. The bowing operation sensor 1 generates an output having a voltage corresponding to a rotational movement (a rotational speed) of the rotatable shaft 51. As is shown in FIG. 1C, both ends of the rotatable shafts 51 are rotatably supported by support members 50 through bearings 55**.

The pitch-setting switches 5 are composed of a plurality of switches which are disposed in a matrix and lie in a fingerboard 5B of a neck portion 5A of the instrument. Four strings 5C are extended along the length of the fingerboard 5B. Ends of the strings 5C are secured to a head portion 5D and the other ends of the strings 5C are secured to the above support member 50. Inside an instrument body 5E there is provided a speaker 5F which is one element of the sound system 17.

OVERALL CIRCUIT CONSTRUCTION

Figure 2:
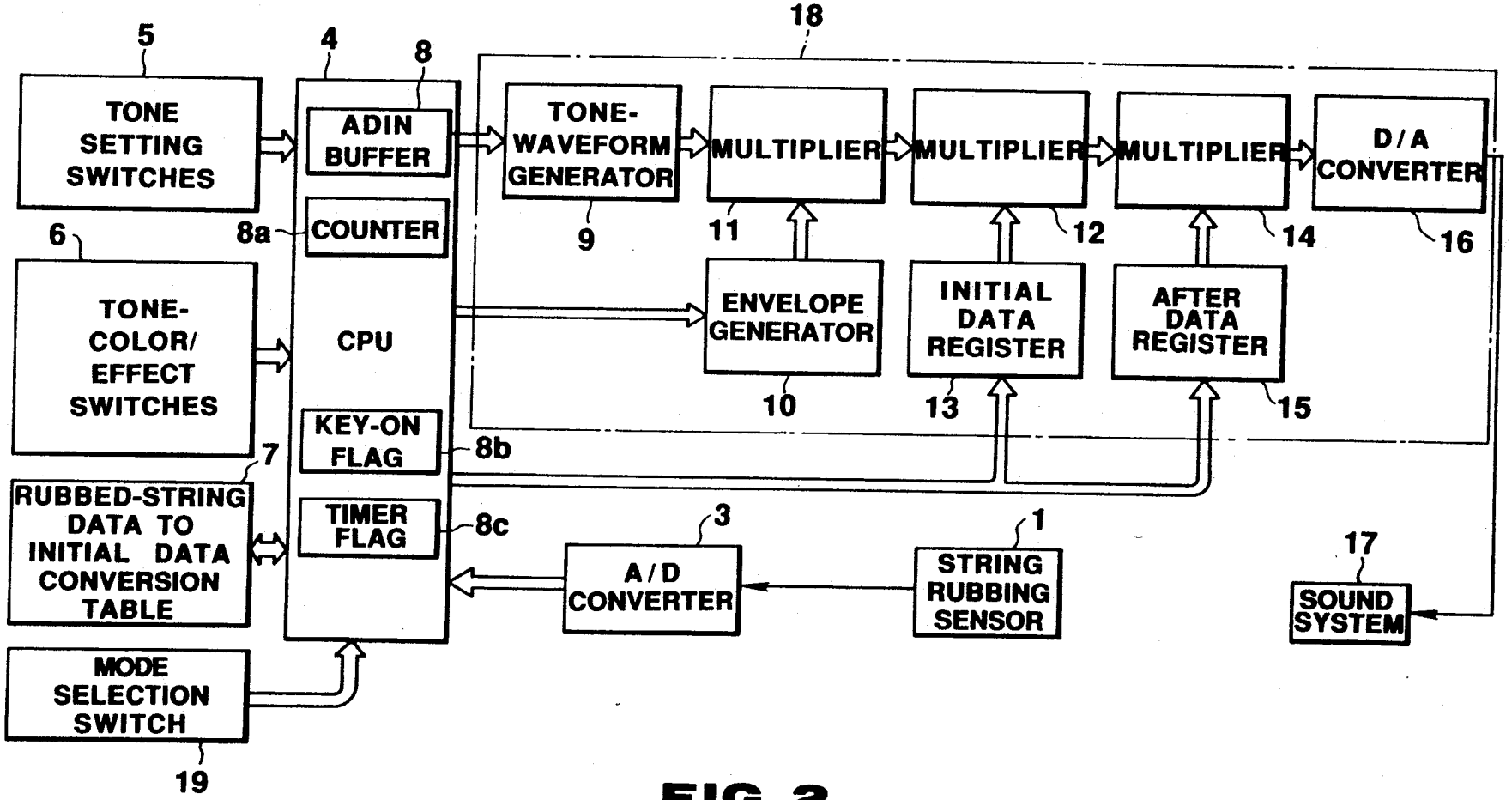
FIG. 2 is a block diagram showing an overall circuit construction used in the embodiment.

FIG. 2 is a view showing an overall circuit construction of the embodiment. The bowing operation detection section SK of the electronic rubbed string instrument KG is provided with the bowing operation sensor 1 which detects the bowing operation speed. An analog voltage signal detected by the bowing operation sensor 1 is converted into a digital bowing data by an analog/-digital converter (A/D converter) 3, which data is supplied to a central processing unit (CPU) 4. CPU 4 controls the operation of the whole circuit of the instrument. To CPU 4 are supplied pitch signal from the pitch-setting switches 5 for setting pitches of tones to be generated and output signals from tone-color/offset switches 6 for switching the tone color of tones and various control effects provided to the tones.

To CPU 4 is connected a bowing-data to initial-data conversion table 7 for converting digital bowing data from the A/D converter 3 into digital initial conversion data. The volume level of the tone is determined according to the digital initial conversion data provided from bowing data to initial data conversion table 7. FIG. 4 shows an example of the contents of the bowing data to initial data conversion table 7. In this example, the table contents are set such that the digital bowing data corresponding to the bowing operation speed will be linearly changing initial conversion data. However, it is possible to permit suitable conversion of the digital bowing data into nonlinear initial conversion data to obtain a special effect. It is possible to use a read-only memory (ROM) in lieu of the conversion table 7. More simply, the conversion table 7 may be dispensed with, and the digital bowing data may be used as the initial conversion data.

CPU 4 controls a tone waveform generator 9 so as to generate a tone waveform corresponding to the bowing operation by operating an internal ADIN buffer 8, a counter 8*a*, etc. The ADIN buffer 8 serves to temporarily store the digital rubbed-string data (0 to 127) provided from the A/D converter 3. When the digital bowing data (0 to 127) exceed a preset value (key-on setting value) (10 in this embodiment), the counter 8*a* starts counting, and after predetermined counting it informs CPU 4 of the end of counting. Further, CPU 4 supplies a control signal to an envelope generator 10 for the generation of an envelope waveform signal determining waveform envelopes such as attack, decay, sustain and release of the tone waveform.

The tone waveform signal supplied from the tone waveform generator 9 is multiplied in a multiplier 11 with an envelope waveform signal from the envelope generator 10 and thereby a tone waveform signal is generated which has a predetermined envelope.

The CPU 4 is controlled so as to generate the initial bowing data for determining the sound volume level at the time of the tone generation. After the tone generation, the CPU 4 is controlled to generate an after bowing data for determining the tone volume level of the tone to be generated.

The tone waveform signal from the multiplier 11 is multiplied in a multiplier 12 by the initial bowing data from an initial data register 13 controlled by the output from CPU 4. The tone waveform signal controlled with the initial bowing data is mulitplied in a multiplier 14 by an after bowing data from the after data register 15 controlled by the output from CPU 4. The tone waveform signal controlled by the after data is converted into an analog signal by a D/A converter 16 to be audibly outputted from the sound system 17.

A mode selection switch 19 constitutes mode selection means for selecting either of a first play mode or a second play mode in initial data generation to be described later. When a signal for selecting the first or the second play mode is supplied from the mode selection switch 19 to CPU 4, CPU4 controls a tone parameter of the tone to be generated from a tone generator 18 in accordance with each play mode. When the first play mode is selected by operation of the mode selection switch 19, the sound volume of the tone at the time of tone generation is determined in accordance with the digital bowing data or the initial bowing conversion data detected by the bowing sensor 1. When the second play mode is selected, the sound volume of the tone at the time of the tone generation is determined independently of the digital bowing data or the initial bowing conversion data detected by the bowing sensor 1 but in accordance with a predetermined value, i.e., the maximum value of the initial bowing data.

The tone waveform generator 19, the envelope generator 10, multipliers 11,12 and 14, the initial data register 13, the after data register 15 and the D/A converter 16 constitute a tone generator 18. In this embodiment, the tone generator 18 is provided together with the sound system in the electronic rubbed-string instrument body KG, but alternatively they may be provided separately from and electrically connected to the electronic rubbed string instrument body KG.

OPERATION

Now, the operation of the embodiment having the above construction will be described.

GENERAL ROUTINE OF CPU

Figure 5:
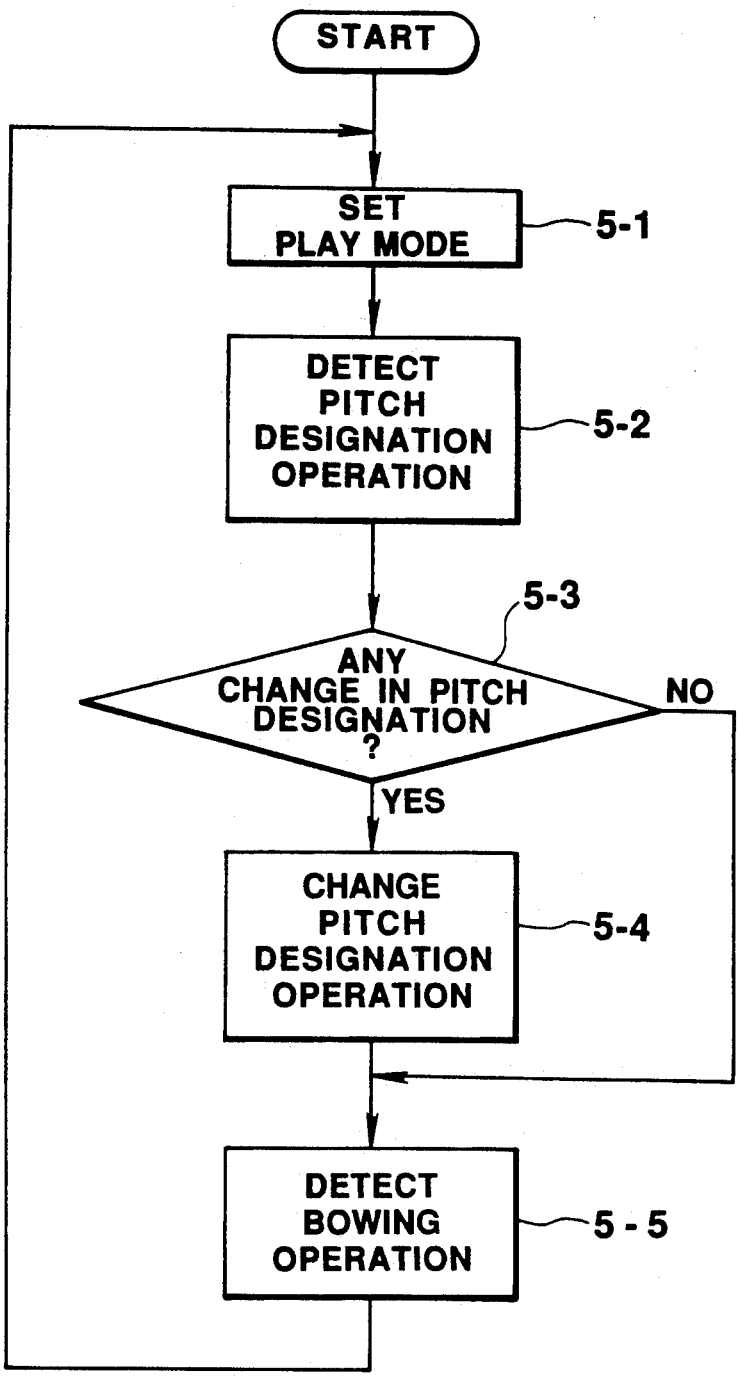
FIG. 5 is a flow chart showing a general operation executed by CPU.

FIG. 5 is a view showing a general flow chart of the operation of CPU 4.

When the power is turned on, at step 5-1 CPU 4 detects switch selection state of the mode selection switch 19 and effects play mode setting according to the detected switch selection state. Then, at step 5-2, CPU 4 performs a pitch designation operation state detection process for detecting the pitch designation operation state of the pitch-setting switches 5. Then, if it is detected at step 5-3 that there has been a change in the pitch designation operation state, CPU 4 performs at step 5-4 a pitch designation operation state change process to change a pitch data to a corresponding pitch data. If it is detected that there has been no change in the pitch designation operation state, the pitch data is not changed. At step 5-5, CPU 4 executes a bowing operation state detection process to detect a bowing operation state performed by the player.

PLAY MODE SETTING PROCESS

Figure 6:
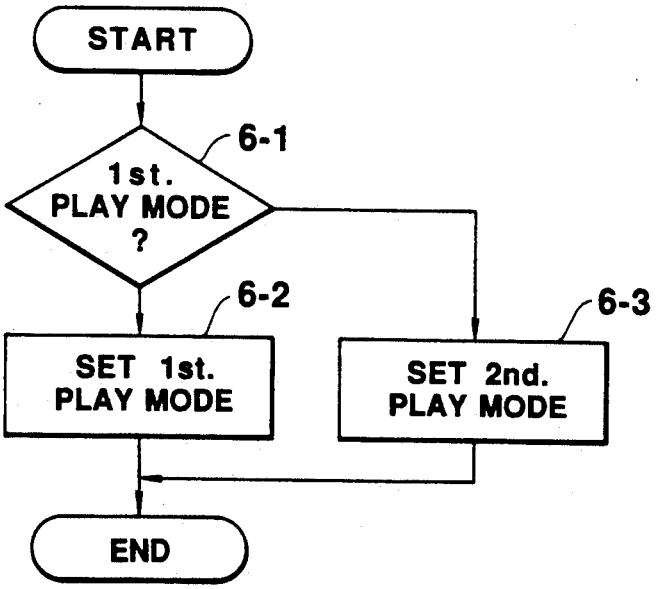
FIG. 6 is a flow chart showing an operation for setting a play mode.

FIG. 6 is a view showing details of the play mode setting process at step 5-1.

At step 6-1, CPU 4 reads in the switch selection state of the mode selection switch 19. If it is detected at step 6-1 that the first play mode has been selected, CPU 4 executes a first play mode setting process at step 6-2 to set the first play mode. If it is detected at step 6-1 that the first play mode setting process has not been selected, CPU 4 executes a second play mode setting process at step 6-3 to set a second play mode. After the first and second play mode setting processes have been executed, CPU 4 terminates the operation of the flow chart.

TIME CHARACTERISTICS OF DIGITAL BOWING DATA

Now, prior to describing the detailed operation of the embodiment, an example of time characteristics of digital bowing data will be described.

Figure 3:
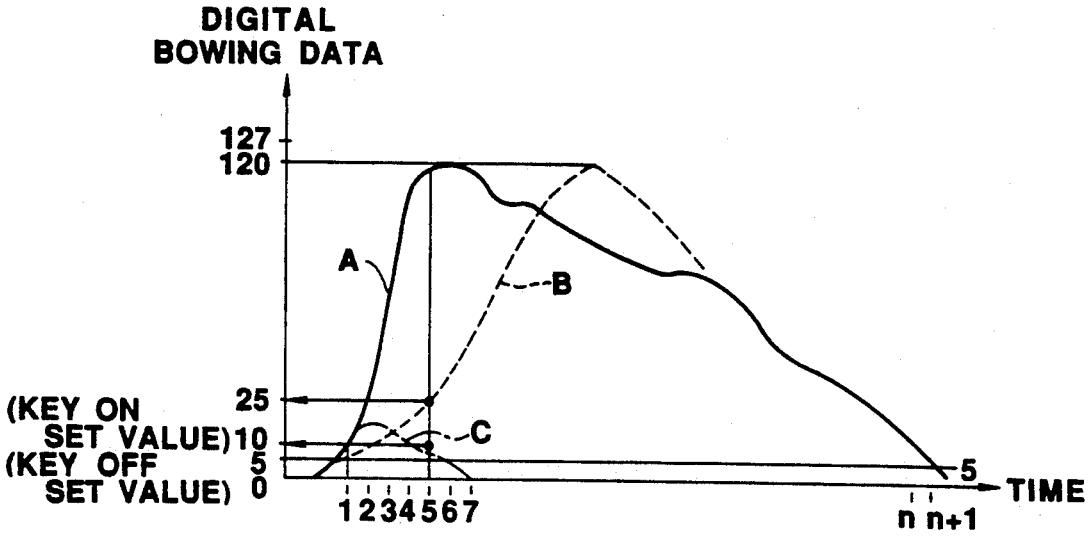
FIG. 3 is a view showing characteristic curves A,B and C of digital bowing data varying with the lapse of time.

FIG. 3 is a view showing the time characteristics of the digital bowing data obtained after conversion in the A/D converter 3 of analog bowing detection signal detected by the bowing sensor 1 into a digital signal. The abscissa is the time elapsed after the commencement of bowing operation and the ordinate is the value of the digital bowing data (of 0 to 127 with a 7-bit resolution of the A/D converter 9). In FIG. 3, a curve A is a characteristic curve obtained when a string is rubbed with a bow at a high speed from the very first. A curve B is a characteristic curve obtained when a bowing speed is gradually increased. A curve C is a characteristic curve obtained when digital and noisy rubbed-string data is detected which is caused when a bow is put on the string.

SETTING OF FIRST PLAY MODE

The operation of the present embodiment will be described in detail in the case where the first play mode is set and in the case where the second play mode is set.

Now, the operation of the embodiment in the first play mode will be described.

Figure 7:
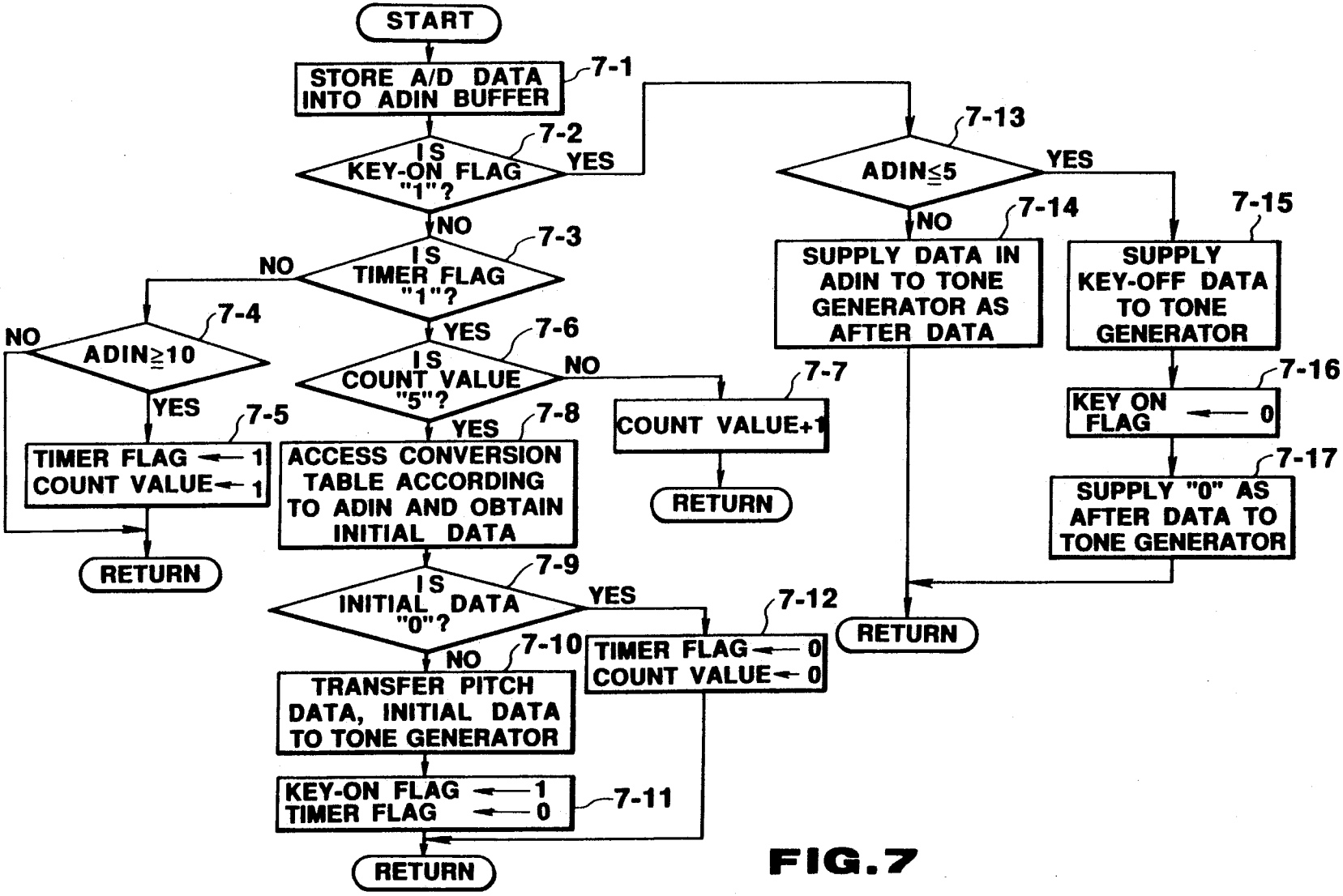
FIG. 7 is a flow chart showing an operation for controlling a tone parameter in a first play mode.

FIG. 7 is a flow chart for tone control when the first play mode is set. The processes shown in the flow chart are executed at a predetermined time interval and the processes may be started at an time interval of 0.1 to several micro sec by means of a time interruption, if necessary.

At step 7-1, digital rubbed-string data provided from the A/D converter 3 is stored in the ADIN buffer 8 in CPU 4. Then, a check is performed at step 7-2 to see whether or not a key is on (a tone is being generated), i.e., whether or not a key-on flag 8*b* is set at 1.

If the key-on flag is initialized since right after the power is turn on, a decision NO is provided and the operation advances to step 7-3. At step 7-3, a check is performed to see whether or not a timer flag 8*c* is set at "1". Since the counter 8*a* is CPU 4 is not counting, a decision NO is again provided at step 7-3. A check is performed at step 7-4 to see whether or not the value of the digital rubbed-string data previously stored in ADIN buffer 8 exceeds a level 10, i.e., the threshold level (preset key on level) at the time of tone generation shown in FIG. 3. If a decision NO is provided, tone generation is not required, so that the operation returns to the main routine. If the digital bowing data exceeds a level 10, for example, at the time 1 in FIG. 3, the operation advances to step 7-5. At step 7-5, the timer flag 8*c* is set at "1" and the count of the counter 8*a* in CPU 4 is set at 1 to start counting. Then, the operation returns to the main routine.

Subsequently, at the time 2 in FIG. 3, processes at steps 7-1 to 7-3 are executed. Since the timer flag 8*c* has been set at "1" at this time, a decision YES is provided at step 7-3 and the operation advances to step 7-6. A check is done at step 7-6 to see whether or not the count of the counter 8*a* is "5", which is the time for generation of initial data. Since the count of the counter 8*a* is still "1", the decision is NO, and the operation advances to step 7-7 to increment the count by "1". The operation then returns to the main routine.

In this manner, processes at steps 7-1 to 7-7 are repeatedly executed. When the count of the counter 8*a* becomes "5", the operation advances to step 7-8 for generation of initial data. At step 7-8, the bowing data to initial data conversion table 7 is accessed with the digital bowing data in ADIN buffer 8 at that time.

As shown in the example in FIG. 3, when data in ADIN buffer 8 of the characteristics curve A at the time corresponding to count "5" of the timer counter 8*a* is "120", the initial conversion data becomes 124 after conversion according to the above conversion table 7. When data in ADIN buffer 8 of the characteristic curve B at the time corresponding to count "5" of the timer counter 8*a* is "25", the initial conversion data becomes as small as 40 after conversion according to the conversion table 7.

Figure 9A:
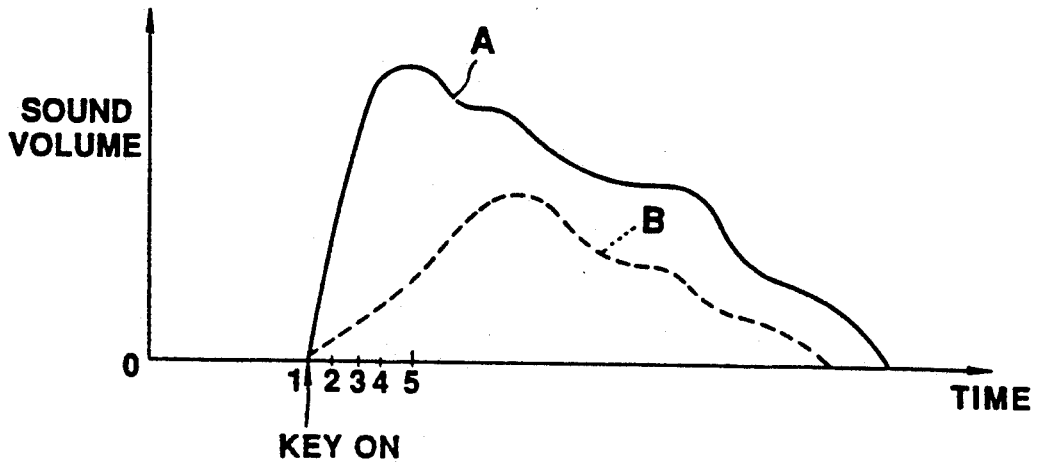
FIG. 9A is a view showing characteristic curves A and B of sound volume controlled in the first play mode.

A check is performed at step 7-9 to see whether or not the present initial conversion data is "0". Since the initial conversion data corresponding to the characteristic curves A and B are "124" and "40", respectively and are not "0", the operation advances to step 7-10. At step 7-10, CPU 4 detects depression of the pitch-setting switches 5 thereby obtaining pitch data and supplies thus obtained pitch data and the initial conversion data "124", "40" to the musical tone generator 18. More specifically, the initial conversion data "124" and "40" are transferring to the initial data register 13. Then, in response to key-on data generated at the time of commencement of counting, the tone-waveform signal output from the tone-waveform generator 9 and the envelope-waveform signal output from the envelope generator 10 are multiplied in the multiplier 11. Since the multiplied tone-waveform signal is supplied from the multiplier 11 to the multiplier 12, the above signal is multiplied by the initial rubbed string data "124" and "40" which have been input in the initial data register 13. As a result, as is shown in FIG. 9A, musical tone is generated with a sound volume corresponding to the characteristic curve A or B in FIG. 3. In case of the characteristic curve A, since the initial conversion data is "124", a musical tone is generated with a sound volume corresponding to the value "124" of the initial conversion data (see the characteristic curve A in FIG. 9A). Meanwhile, in case of the characteristic curve B, since the initial bowing data is "40", a musical tone is generated with a sound volume corresponding to the value "40" of the above data (see the characteristic curve B in FIG. 9A).

After the pitch data and the initial conversion data are supplied to the musical tone generator 18, at 7-11, the key-on flag 8*b* is set at "1" and the key-on flag 8*c* is set at "0" and thereby the counter 8*a* is ready for counting. Then the operation returns to the main routine.

In case of the characteristic curve C in FIG. 3, i.e., in case where a noisy input caused when a bow is put on strings and irrelevant to a musical performance, and an input caused by a bowing operation performed in wrong are detected as digital bowing data, it is determined at step 7-9 that the initial data is "0" for the count "5" of the timer counter 8a. Therefore, in such a case, it is determined that there is no musical performance input. It is thus possible to prevent occasional commencement of tone generation. After pitch data and other data have been supplied to the musical tone generator 18, at step 7-12 the timer flag 8c is set at "0" and the count of the counter 8a is set at "0" for initialization. Then, the operation returns to the main routine.

If it is detected at step 7-2 that key is "on", it means that a tone is being sounded, so that the presence of the initial data can be ignored. A check is performed at step 7-13 to see whether or not digital conversion data stored in ADIN buffer 8 at step 7-1 is less than a predetermined key-off setting value 6. If the decision is NO, it is necessary to control the musical tone being sounded in accordance with the after bowing data. At step 7-14, the digital conversion data in ADIN buffer 8 is transferred as after bowing data to the musical tone generator 18. More specifically, the after bowing data is transferred through the after data register 15 to the multiplier 14. Thus, the after bowing data is multiplied by the tone-waveform signal from the multiplier 12 in the multiplier 14. The tone parameter after tone generation is controlled in accordance with the after bowing data, and the operation returns to the main routine.

If a decision at step 7-13 is YES, a process of muting the tone being sounded has to be executed. Thus, at step 7-15, key-off data is supplied to the musical tone generator 18. At step 7-16, the key-on flag 8b is set at "0". Further, after data "0" is supplied as after bowing data to the musical tone generator 18 at step 7-17, the operation returns to the main routine.

When in the first play mode the bow is moved across the strings with a characteristic as shown by the characteristic curve A in FIG. 3, i.e., when the player bows fast at the beginning and then bows slowly, the generation of a desired tone is controlled in response to the bowing speed and with a characteristic as shown by the characteristic curve A in FIG. 9A. In this case, when the value "120" of the initial bowing data is large, a musical tone having a high attack is produced from the time of start of counting. After reaching the peak value, the musical tone is controlled on the basis of the after bowing data, and then the musical tone decreases gradually. When the instrument is bowed with a characteristic as indicated by the characteristic curve B in FIG. 3, i.e., when the player bows the instrument such that the bowing speed is low at the beginning and gradually increases until it reaches the peak level and then decreases again, the generation of a desired musical tone is controlled in response to the bowing speed and with a characteristic as indicated by the characteristic curve B in FIG. 9A. In this case, when the value 40 of the initial bowing data is relatively small as is shown by the characteristic curve B in FIG. 9A, the musical tone to be generated from the commencement of counting has a comparatively weak attack. When the initial bowing data value is small at the commencement of tone generation, the sound volume level of a tone to be generated is determined on the basis of that small value. Therefore, when the player gradually increases the bowing speed until it reaches a peak level, the sound volume level according to the initial bowing data value is multiplied only by the after bowing data value. For this reason, the sound volume level never reaches the peak level. Thus, the sound volume level varies within a narrow variation range after the tone generation.

Further, when a bowing operation is performed irrelevanting to a musical performance and with a characteristic as indicated by the characteristic curve C in FIG. 3, no tone is generated since the initial bowing data is "0" for the count "5" of the counter 8a. As a result, even when there is an occasional bowing operation performed by mistake, it is possible to prevent an accidental generation of tone.

SETTING SECOND PLAY MODE

Now, the operation of the embodiment in a second play mode will be described.

Figure 8:
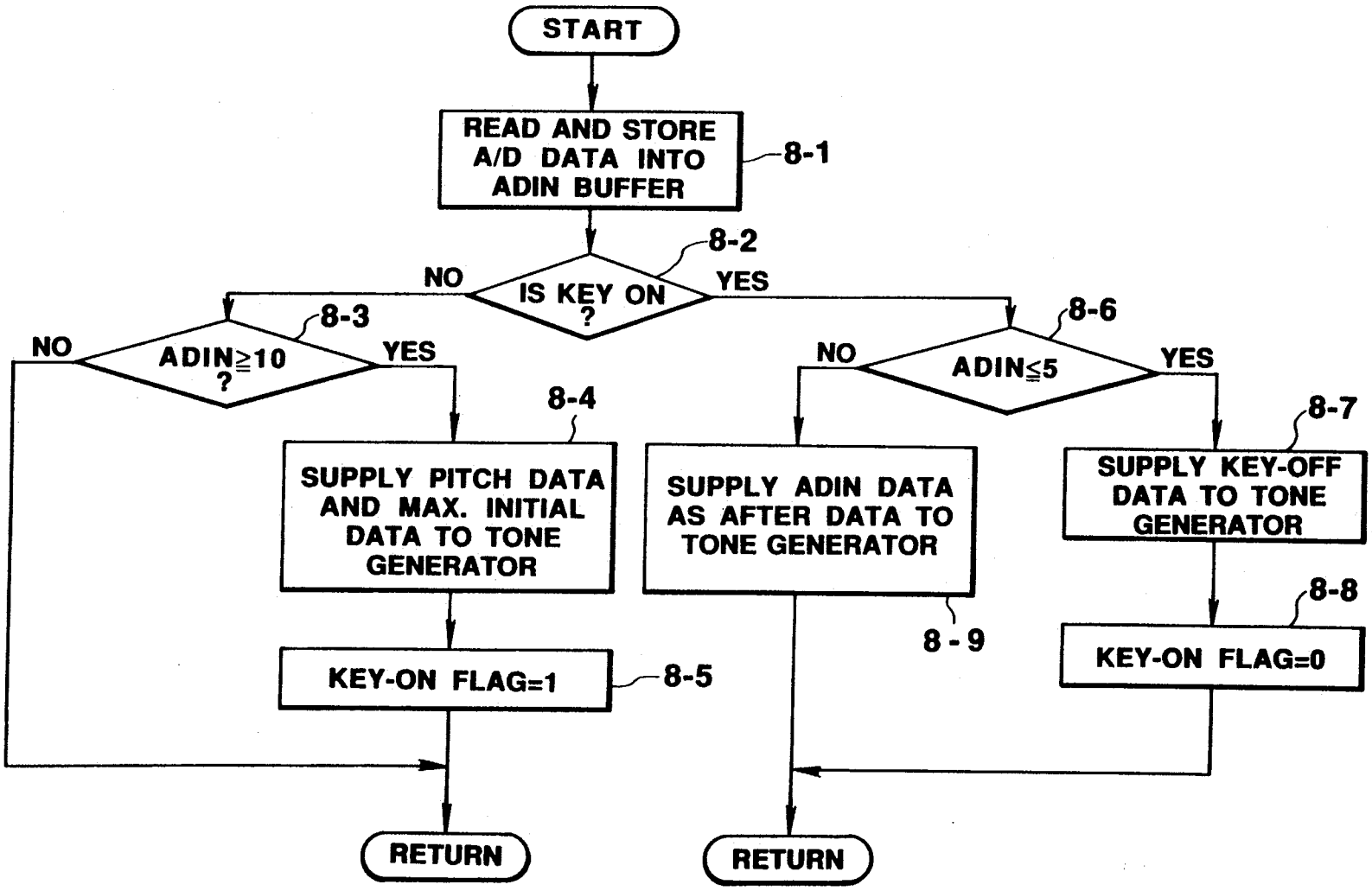
FIG. 8 is a flow chart showing an operation for controlling a tone parameter in a second play mode.

FIG. 8 is a flow chart for a tone control in the second play mode.

At step 8-1, an output signal of A/D converter 3 is converted on the basis of the conversion table 7 and thus converted signal is read into ADIN buffer 8 in CPU 4 to be stored therein. A check is done at step 8-2 to see whether or not key is on, i.e., key-on flag 8b is set at "1".

If the key-on flag 8b is initialized in the main routine, a check is performed at step 8-3 to see whether or not the digital conversion data stored in ADIN buffer 8 is no less than a level "10" as a key-on setting value shown in FIG. 3.

If the decision is NO, it is regarded that there is no bowing operation input and the operation returns to the main routine. If the digital conversion data is equal to and/or more than a level 10 at the time count 1 as shown in FIG. 3, the operation advances to step 8-4, where pitch data set by the depression of the pitch-setting switches 5 and a value corresponding to the maximum value "127" as initial data are supplied to the initial data register 13 in the musical tone generator 18. The initial data is transferred from the initial data register 13 to the multiplier 12.

Thus, when the second play mode is set, the value corresponding to the maximum value of "127" as the initial bowing data is transferred at all time from the initial data register 13 to the multiplier 12. In the second play mode, the initial conversion data "127" and "40" stored in the multiplier 12 and the initial data register 13 are not use as data for controlling a sound volume as a musical-tone parameter.

At following step 8-5, the key-on flag 8b is set at "1" and the operation returns to the main routine.

If it is decided at step 8-2 that a key is being "on", a check is performed at step 8-6 to see whether or not the data stored in ADIN buffer 8 is no more than a level "5" as a preset key-on level. If the data is no more than the level "5" at count time n+1, the tone being sounded is to be muted. Thus, at step 8-7 key-off data is provided to the musical-tone generator 18 and at subsequent step 8-8 the key-on flag 8b is set at "0" before the operation returns to the main routine.

If a decision NO is produced at step 8-6, the tone sounding is continued, and it is necessary to control the tone parameter of the tone being sounded in accordance with the after data. Therefore, the after data for controlling the tone parameter is to be generated. Hence, at step 8-9, the data stored in ADIN buffer 8 at step 8-1, i.e., the digital conversion data is supplied as the after data to the musical-tone generator 18. More specifically, the digital bowing data transferred to the after data register 15 to be stored therein is supplied to the multiplier 14. The digital bowing data is multiplied in the multiplier 14 by a tone waveform signal. The operation then returns to the main routine.

Figure 9B:
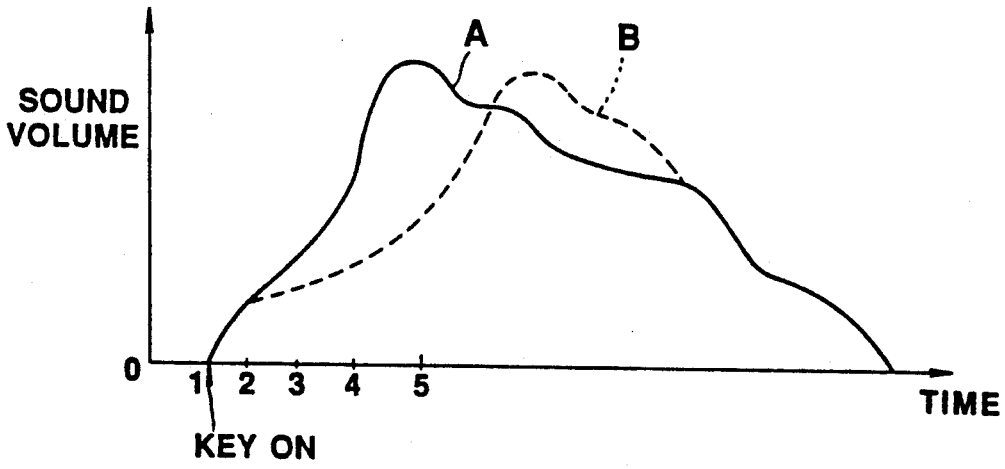
FIG. 9B is a view showing characteristic curves A and B of sound volume controlled in the second play mode.

In this way, when the player bows fast from the beginning as shown by the characteristic curve A of the time characteristic of the digital bowing data in FIG. 3, a musical tone is sounded which has a sound volume variation characteristic corresponding to the level of the actual bowing input, as shown by the characteristic curve A in FIG. 9B. When the player bows such that the bowing speed is slow at the beginning and is gradually increased up to the peak value like the characteristic curve A, the sound volume level first rises showly in the attack, then gradually increases up to the peak level and then gradually attenuated and muted in a subsequent attenuation step as shown by the characteristic curve B in FIG. 9B. With a construction made such that when a tone color of a continuous tone system is selected depending on the kind of the tone color of the tone to be sounded, the second play mode is automatically selected, and on the contrary when the tone color of the attenuating tone system of piano and the like is selected, the first play mode is automatically set, it is possible to give a performance with tones having volume-variation characteristics appropriate to the tone colors.

Now, another embodiment of the present invention will be described in detail.

Figure 10:
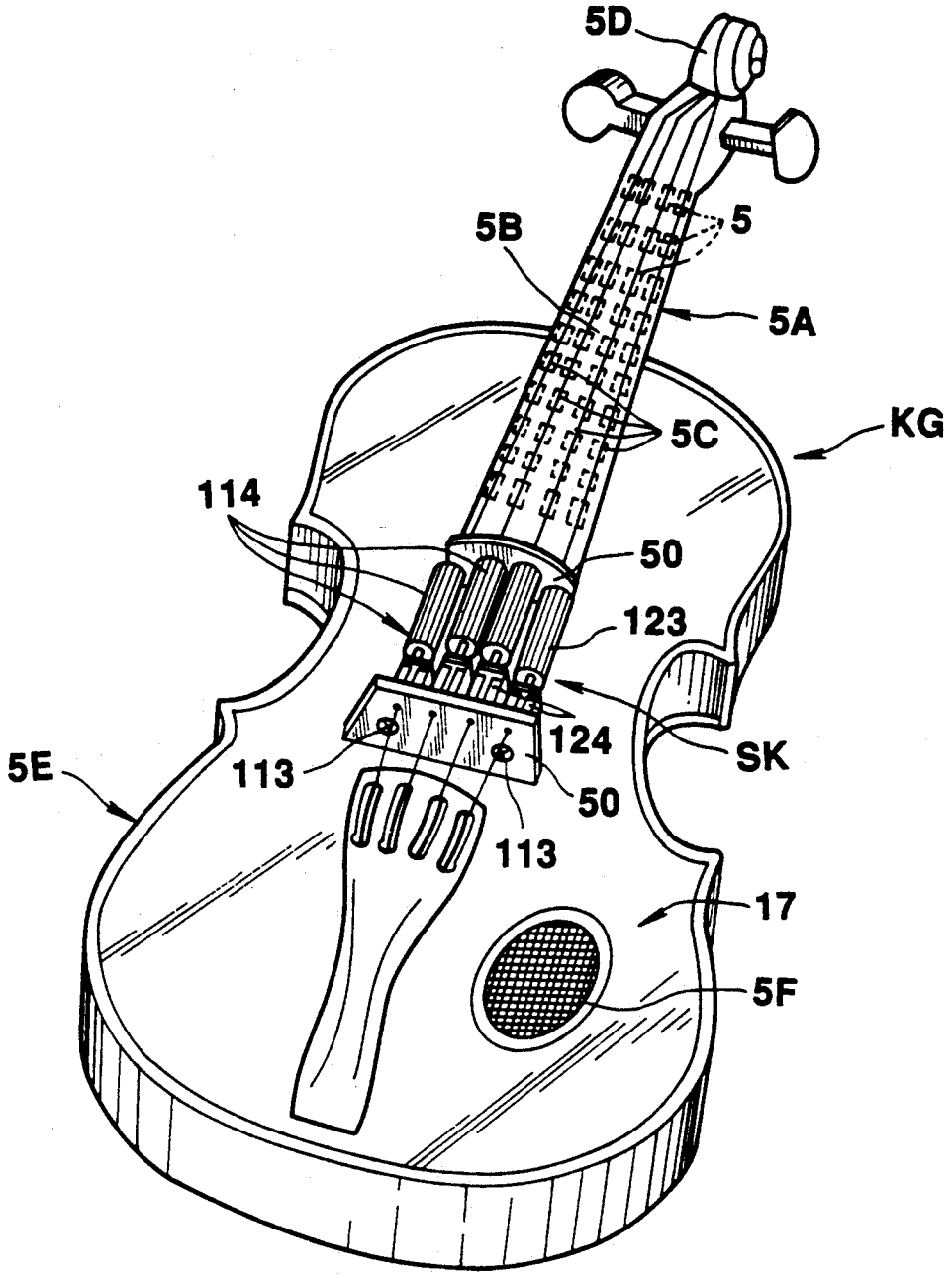
FIG. 10 is a perspective view showing other embodiment of an electronic rubbed string instrument to which the present invention is applied.

FIG. 10 is an external view of an electronic rubbed string instrument to which the present invention is applied.

Similar to the above embodiment, the electronic rubbed string instrument has a violin shaped body KG. The instrument body KG is composed of a body 5E, a neck 5A and a head 5D. On the body 5E, there are provided a bowing-operation detection section SK and a speaker 5F of a sound system 17, which will be described later. Pitch-setting switches 5 comprising a number of pitch-designation switches disposed in matrix are buried in a fingerboard 5B of the neck 5A. Four strings 5C are expanded along the finger board 5B of the neck 5A. Ends of the strings 5C are secured to the head 5D and other ends of the stings 5C are also secured to a support plate 50.

Figure 11:
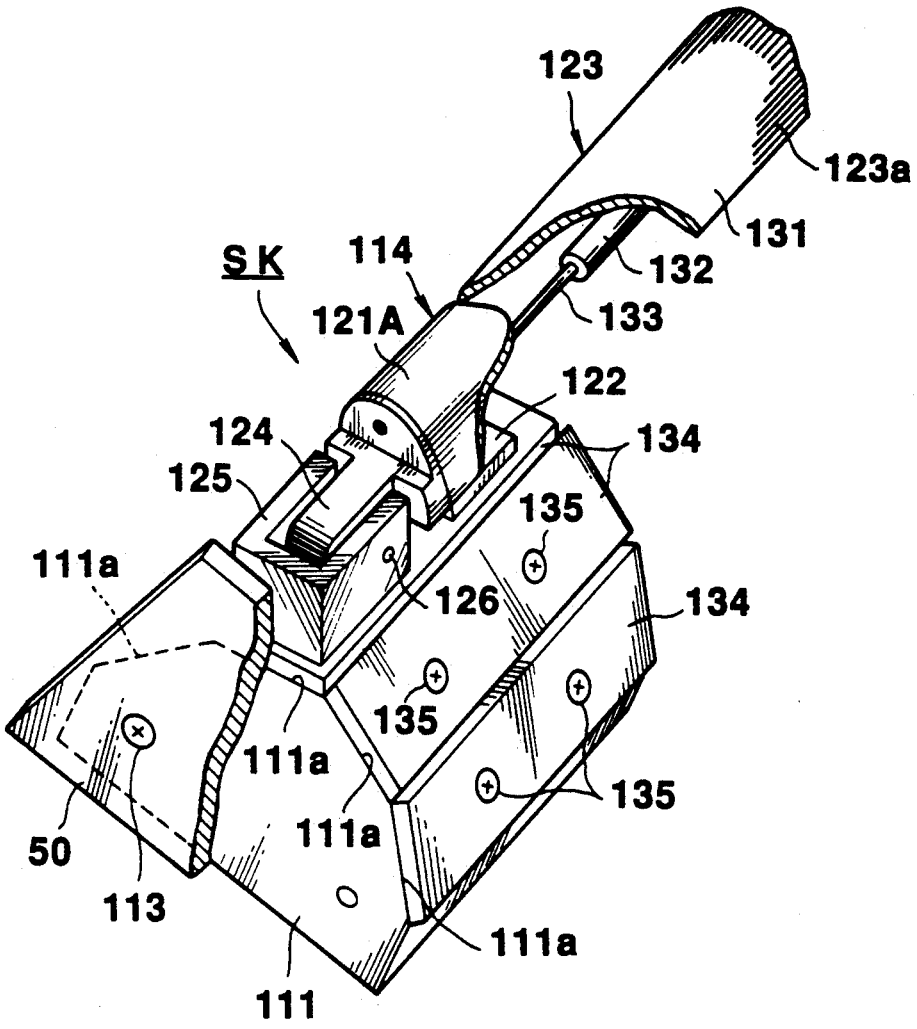
FIGS. 11 and 12 are a perspective view and a cross-sectional view showing a main portion of the electronic rubbed string instrument shown in FIG. 10.
Figure 12:
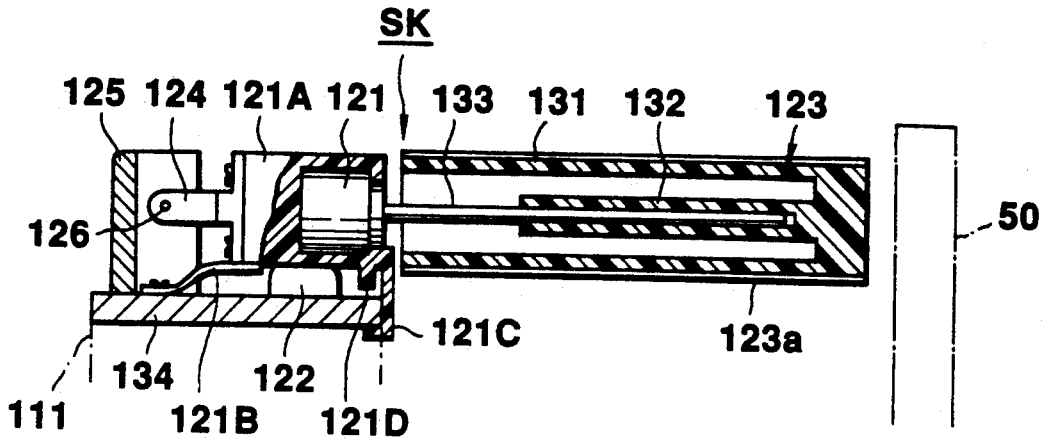

FIG. 11 and 12 are views illustrating the bowing-operation detection section SK of the electronic rubbed string instrument.

The bowing-operation detection section SK is provided with a base member 111, which is secured with screws 113 to the support plate 50 installed on the body 5E. On four surfaces 111*a* of the base member 111 bowing-operation detection mechanisms 114 corresponding to respective strings 5C are mounted. As these bowing-operation detection mechanisms 114 have the same construction, only one of the mechanisms is illustrated and described in FIG. 11.

The bowing-operation detection mechanism is composed of a generator (bowing-speed detection speed) 121, a pressure sensor (bowing-operation pressure detection sensor) 122 and a roller 123, as shown in FIG. 12. The generator 121 is accommodated in a generator holder 121A, which has a support arm 124 pivotally mounted at a support shaft 126 to a support member 125 provided on the base member 111. The generator holder 121A is biased upwards by a leaf spring 121B, but the holder 121A is usually retained at its predetermined upper position by an action of a stopper 121C fixed on the holder 121A. A limit pin 121D is provided on lower end of the generator holder 121A for preventing a further down movement of the generator holder 121A from its predetermined position. The pressure sensor 122 is mounted on the base plate 111 at the position facing to the generator holder 121A. When the generator holder 121A urged upwards by the leaf spring 121B is retained at its predetermined upper limit position by the stopper 121C, the generator holder 121A only contacts with an upper surface of the pressure sensor 122, so that the output of the pressure sensor 122 is "0" or is deemed to be "0".

A roller 123 is made of plastic materials, rubber materials or the like. The roller 123 is a tubular member 131 with its one end closed and also with its peripheral surface 123*a* knurled. The tubular member 131 has a center shaft portion 132 extending from the closed end portion and along the center line of the tubular member 131. In the center shaft portion 132 of the roller 123 is buried one end of an elongated rotary shaft 133 of the generator 121. In this way, the roller is supported on one end of the rotary shaft 133 of the generator 121. On the four surfaces 11*a* of the base member 111 are secured, if necessary, adjustment plates 134 having an appropriate thickness, on which the support member 125 of the generator 121 and the pressure sensor 122 are mounted with use of the adjustment plate 134 the height of the bowing operation detection mechanism, specially the height of the roller can be adjusted. It is possible to indirectly connect the rotary shaft 133 of the generator 121 with the center shaft portion 132 of the roller 123 through, for example, a coil spring, instead of connecting them directly.

In the embodiment, when the roller 123 is bowed with a bow (not shown), the roller 123 rotates in proportion to the bowing speed, i.e., the speed of the bow movement and the generator 121 is driven by the roller to provide an output voltage which varies with the rotational speed of the roller. With the construction mentioned above, the generation of a predetermined musical tone is started and the sound volume of the musical tone being sounded is controlled on the basis of the variation of the output voltage from the generator 121, as will be described later. In addition, when the roller is pressed with the bow, the generator 121 together with the roller 123 is displaced downwards, i.e., towards the finger board 5B against the influence of the leaf spring 121B and in proportion to the pressure applied to the roller 123, i.e., the bowing operation pressure. Then, the pressure sensor 122 is pressed by the generator holder 121A in accordance with the displacement value of the generator 121, thereby being elastically deformed. As the result, the output voltage of the pressure sensor 122 is varied, and contents of tone color of the musical tone being sounded is controlled on the basis of the variation in the output voltage of the pressure sensor 122, as will be described later.

Figure 13:
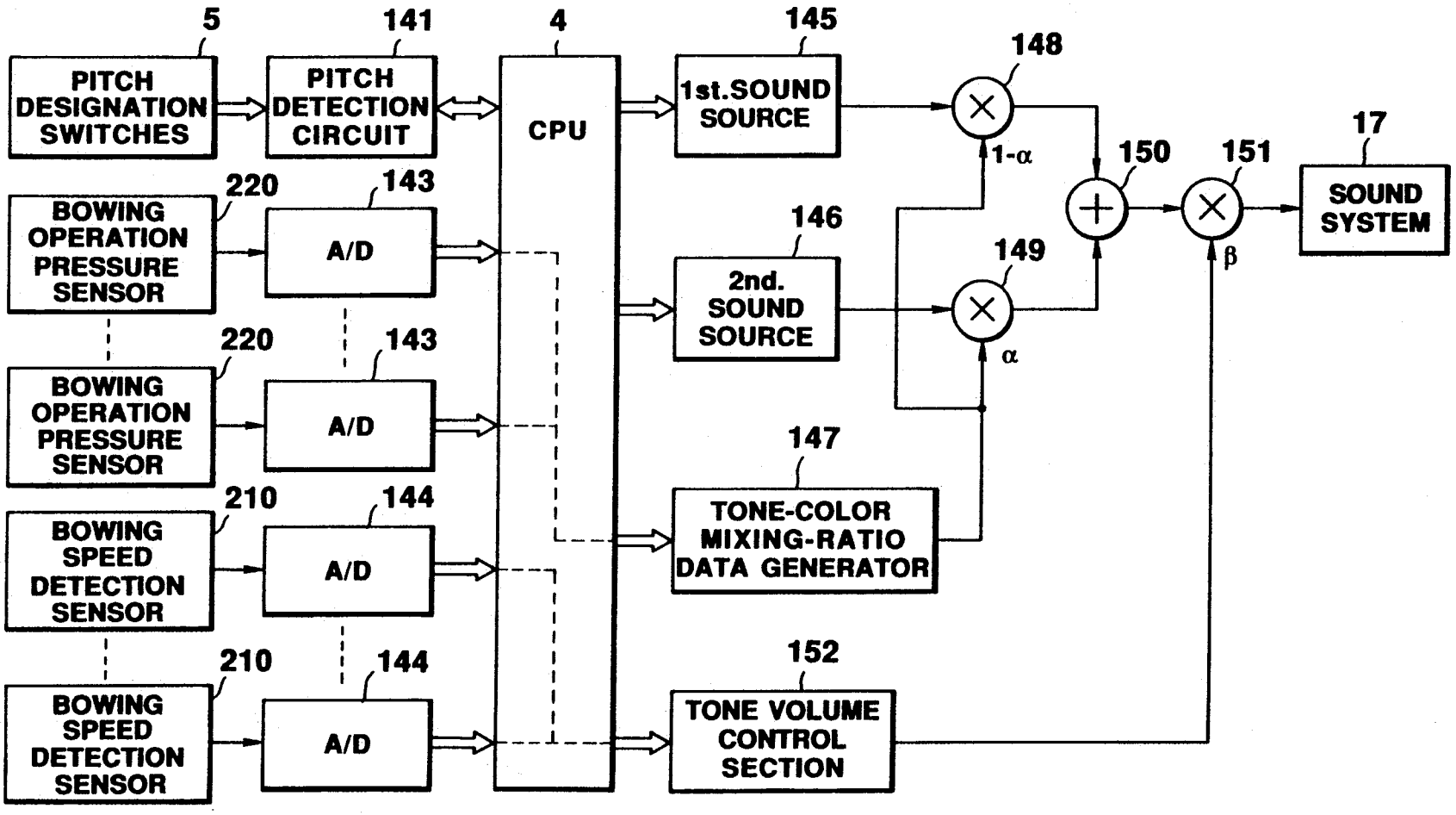
FIG. 13 is a block diagram showing an example of an overall circuit construction of the electronic rubbed string instrument in FIG. 10.

FIG. 13 is a block diagram of the overall circuit construction of the electronic rubbed string instrument.

The electronic rubbed string instrument is constructed such that a pitch designation operation state of the pitch designation switches 5 is detected by a pitch detection circuit 141 and a pitch designation signal output from the pitch designation circuit 141 is supplied to the central processing unit (CPU) 4. CPU 4 serves to control operations of the overall circuits of the musical instrument. Detected signals of bowing-operation pressure detection sensors each composed of a pressure sensor 122 are converted into digital bowing-operation pressure data by analog/digital (A/D) converters 143 and thereafter are supplied to CPU 4. Detected signals of bowing-speed detection sensors 210 each composed of the generator 141 are converted into digital bowing-speed data by A/D converters 144 and then supplied to CPU 4.

On the basis of the pitch designation signal supplied from the pitch detection circuit CPU 4 controls and causes a first sound source 145 and a second sound source 146 to generate predetermined tone waveforms having the same pitch but different tone colors. Further, CPU 4 supplies a tone-color mixing-ratio data generator 147 with digital bowing-operation pressure data supplied from the four A/D converters 143. The tone-color mixing-ratio data generator 147 converts the supplied digital bowing-operation pressure data into tone-color mixing-ratio data $\alpha$ and $1-\alpha$. The tone-color mixing-ratio data $1-\alpha$ is supplied to a multiplier 148, in which the data $1-\alpha$ is multiplied by the output (first tone signal) of the first sound source 145. Other tone-color mixing-ratio data $\alpha$ is supplied to other multiplier 149, in which the data $\alpha$ is multiplied by the output (second tone signal) of the second sound source 146. A weighted first tone signal from the multiplier 148 and a weighted second tone signal from the multiplier 149 are added to each other in an adder 150. The added tone signal is supplied to a multiplier 151.

Detecting the fact that four digital bowing speed data supplied from the A/D converters 144 exceed a predetermined set value. CPU 4 provides a tone generation instruction signal to the first and second sound sources 145 and 146 and provides to a tone volume control section 152 a response control signal corresponding to the digital bowing speed data at that time. On the basis of the supplied tone generation instruction signal, the first and the second sound sources 145 and 146 generate predetermined tone waveforms. Meanwhile, the tone volume control section 152 is composed of an amplitude converter (e.g., attenuator) which alters an amplitude of the tone signal in the multiplier, i.e., alters the tone volume of the tone signal on the basis of the digital bowing-speed data supplied thereto as a variable. The tone signal output from the multiplier 151 is further supplied to the sound system 17. Hence, the sound system generates a musical tone having the tone volume corresponding to the digital bowing speed data.

Now, the operation of the electronic rubbed string instrument will be described.

When the pitch designation switches 5 of the electronic rubbed string instrument are operated to designate a tone pitch, the pitch detection circuit 141 detects the operation state and outputs a pitch designation signal to CPU 4. On the basis of the supplied pitch designation signal, CPU 4 controls the first and second sound sources 145 and 146 so as to generate two tone waveforms having the same pitch and different tone colors. The generated tone waveforms are supplied to the multipliers 148 and 149, respectively.

When a bowing operation pressure is applied with the bow to the roller 123 of the musical instrument, the bowing operation pressure is detected by the bowing-operation pressure detection sensor 220 composed of the pressure sensor 122 and then converted into a digital bowing-operation pressure data by the A/D converter 143. The digital bowing-operation pressure data is supplied to CPU 4. The speed of a bow movement is detected by the bowing speed detection sensor 210 composed of the generator 121 and then converted into a digital bowing speed data by A/D converter 44. The digital bowing speed data is further supplied to CPU 4. CPU 4 supplies the former digital bowing-operation pressure data to the tone-color mixing-ratio data generator 147 and supplies the latter digital bowing-speed data to the first and second sound sources 145 and 146 and also to the tone-volume control section 152.

Figure 14A:
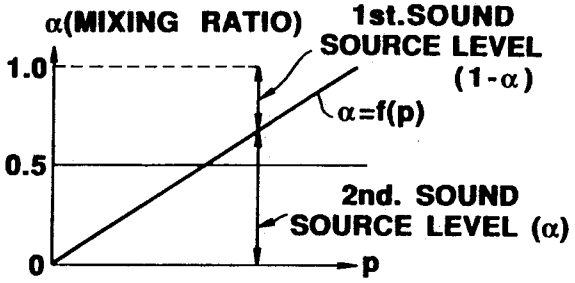
FIG. 14A to 14C are views showing graphs indicating a tone-color mixing-ratio conversion-function employed in the electronic rubbed string instrument.
Figure 14B:
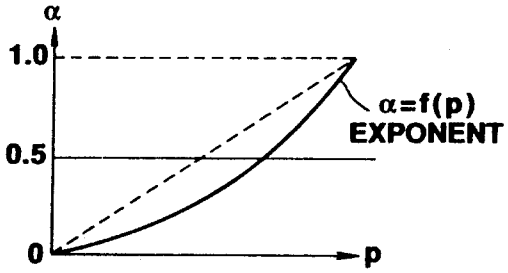
Figure 14C:
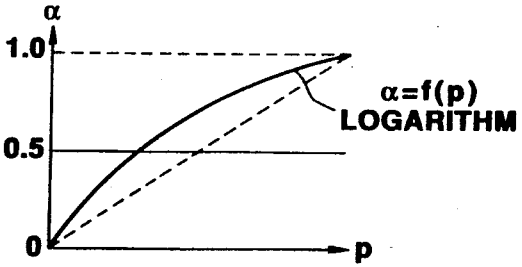

The tone-color mixing-ratio data generator 147 provides a function data of a tone-color mixing-ratio conversion function $\alpha=f(p)$ of a variable, i.e., a digital bowing-operation pressure data P. FIGS. 14A to 14C are graphs illustrating variations in function $\alpha(0\leqq\alpha\leqq1)$ on coordinate axes (p-distance, $\alpha$-distance). As shown in FIGS. 14A to 14C, function $\alpha$ is given by an arbitrary function such as a linear function, an exponential function and a logarithm function. If the function $\alpha=f(p)$ is given by a linear function, the value of function $\alpha$ linearly increases within the range $0\leqq\alpha\leqq1$ as digital bowing-operation data P increases as shown in FIG. 14A. Hence, the tone waveform signal from the first sound source 145 is processed by the multiplied 148 such that the amplitude is multiplied by "$1-\alpha$" and in the same way, the tone waveform signal from the second sound source 146 is processed by the multiplier 149 such that the amplitude is multiplied by "$\alpha$", and thereafter these tone waveform signals are added to each other by the adder 150.

Figure 15A:
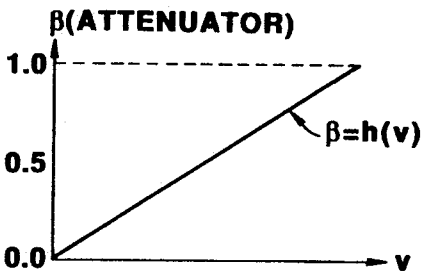
FIG. 15A to 15C are views showing graphs indicating an amplitude conversion function employed in the electronic rubbed string instrument.
Figure 15B:
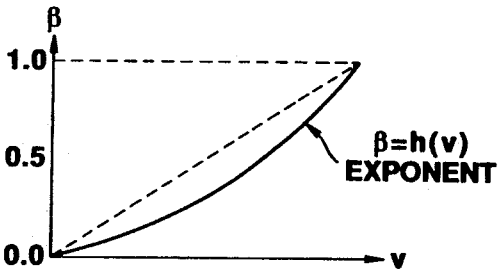
Figure 15C:
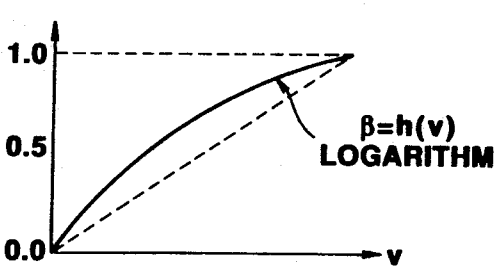

The tone volume control section 152 provides a function data of an amplitude function $\beta=h(v)$ of digital bowing speed data V. FIGS. 15A to 15C are graphs illustrating variations in the function $\beta(0\leqq\beta\leqq1)$ on coordinate axes (v-distance, $\beta$-distance). The function $\beta$ is given by an arbitrary function such as a linear function, an exponential function and a logarithm function. If the function $\beta$ is given by a linear function $\beta=h(v)$, the value of function $\beta$ linearly increases within the range $0\leqq\beta\leqq1$, as digital bowing-speed data V increases. The tone waveform signal from the multiplier 150 is multiplied by the value of amplitude function $\beta$ by the multiplier 151. The tone waveform signal having a controlled amplitude, i.e., a controlled sound volume is supplied to the sound system 7 and then acoustically output therefrom.

Now, the operation of the electronic rubbed string instrument will be more specifically described. It is assumed that the electronic rubbed string instrument is constructed such that the first sound source 145 generates a musical tone having a soft tone color and the second sound source 146 generate a musical tone having a hard tone color, and further the value of tone-color mixing-ratio conversion function $\alpha$ of the tone-color mixing-ratio data generator 147 increases as digital bowing-operation pressure data P, i.e., bowing operation pressure increases. Furthermore, it is assumed that the electronic musical instrument is constracted such that the value of amplitude function of the tone volume control section 152 increases as digital bowing-speed data V, i.e., the speed of bowing movement increases.

Then, (1) in case that the bow is moved slowly across the roller 123 with the same bow being slightly pressed onto the roller 123, the bowing-operation pressure applied to the roller 123 becomes low and the bowing speed becomes low. Therefore, since the value of digital bowing-operation pressure data P is small, and the amplitude of the tone-waveform signal from the first sound source 145 is set to be large and the amplitude of the tone-waveform from the second sound source 146 is set to be small. Further, since the value of digital bowing-speed data V is small, the sound volume level is set to be low. Therefore, a musical tone having a soft tone color and low sound volume is generated.

(2) In case that the bow is moved fast across the roller 123 with the same bow being slightly pressed onto the roller 123, the bowing-operation pressure becomes low and the bowing-speed becomes high. Therefore, the value of digital bowing-operation pressure data P will be small and the value of digital bowing-speed data V will be large. Hence, the amplitude of the tone-waveform signal from the first sound source 145 is set to be large and the amplitude of the tone-waveform signal from the second sound source 146 is set to be small. Further, the tone volume level is set to be large. Therefore, a musical tone having a soft tone color and high sound volume is generated.

(3) In case that the bow is moved slowly across the roller 123 with the same bow being pressed strongly onto the roller 123, the bowing-operation pressure applied to the roller 123 becomes high and the bowing speed becomes low. Therefore, the value of digital bowing-operation pressure data P will be large and the value of digital bowing speed data V will be small. Hence, the amplitude of the tone-waveform signal from the first sound source 145 is set to be small and the amplitude of the tone waveform signal from the second sound source 146 is set to be large and further tone volume level is set to be low. Therefore, a musical tone having a hard tone color and large sound volume is generated.

(4) In case that the bow is moved fast across the roller 123 with the same bow being strongly pressed onto the roller 123, the bowing-operation pressure becomes high and the bowing speed becomes high. Therefore, the value of digital bowing-operation pressure data P will be large and the value of digital bowing speed data V will be large. Hence, the amplitude of the tone waveform signal from the first sound source 145 is set to be low and the amplitude of the tone waveform signal from the second sound source 146 is set to be high and further tone volume level is set to be low. As a result, a musical tone having a hard tone color and large sound volume is generated.

In the electronic rubbed string instrument, content of tone color and tone volume of a musical tone being generated are controlled in accordance with bowing operation pressure and a bowing speed. For this reason, it is possible to play this electronic rubbed string instrument in a similar manner to typical acoustic rubbed string instruments such as violins, violas and cellos.

Figure 16:
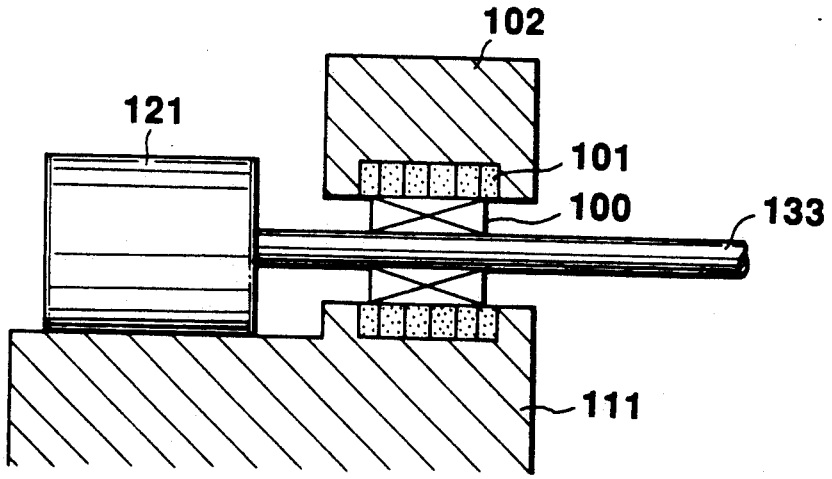
FIG. 16 is a cross-sectional view showing other embodiment of the bowing operation detection section.

The above mentioned embodiment is constructed such that the pressure sensor 122 is provided under the generator holder 121A and the pressure sensor 122 detects a displacement amount when the generator holder 121A together with is displaced, but the invention is not limited to the above mentioned construction. For example, as shown in FIG. 16. it is possible to construct an embodiment of the invention such that the generator 121 is secured to the base member 111 and its rotary shaft 133 is rotatably supported by a bearing 100 which is retained in a ring-shaped pressure sensor 101 mounted on a supporting member 102 and the ring-shaped pressure sensor 101 detects a displacement amount when the rotary shaft 133 and the bearing 100 are displaced together with the roller 123 by bowing operation.

In the above mentioned embodiments, content of tone color of a musical tone to be generated is controlled in accordance with the level of the bowing-operation pressure, but the invention is not limited to the above mentioned constructions of the embodiments. For example, it is possible to control various musical parameters other than the tone color, such as tone volume level, a tone pitch and the like.

In the above described embodiment the tone generator 18 is provided with multipliers 11, 12 and 14 for multiplying the tone waveform signal from the tone-waveform generator 9 by various data values to control tone parameters of the tone being generated, but this structure is by no means limitive. Further, it is possible to omit mode selection switch 19.

The above embodiments have concerned with a violin-shaped musical instrument body KG, but this is by no means limitative; for example, the invention may be applied as well to rubbed string instruments such as violas, cellos, contrabass and the like.

In the above embodiments, the tone volume of the tone to be generated and the tone volume of the tone being generated are controlled in accordance with initial-bowing data and after-bowing data, but it is possible, for example, to control tone color and/or tone pitch of the tone to be generated or being generated in accordance with the initial-bowing data and after-bowing data. An embodiment of the invention may be structured such that when bowing operation is performed fast, piano sound is generated and when the bowing operation is performed slowly, flute sound is generated.

In the above embodiment, the rubbed string instrument body Kg is provided with the bowing-speed detection section MP, pitch-setting switches 5 and the sound system 17. However, a sound system may be provided separately from the instrument body KG.

Further, in the above embodiment, only one initial data conversion table 7 is prepared, however, it is possible to provide a plurality of different initial data conversion tables, which are selectively used depending on tone selection and the like.

Now, another embodiment of the invention will be described with reference to FIGS. 17A through 20.

Figure 17A:
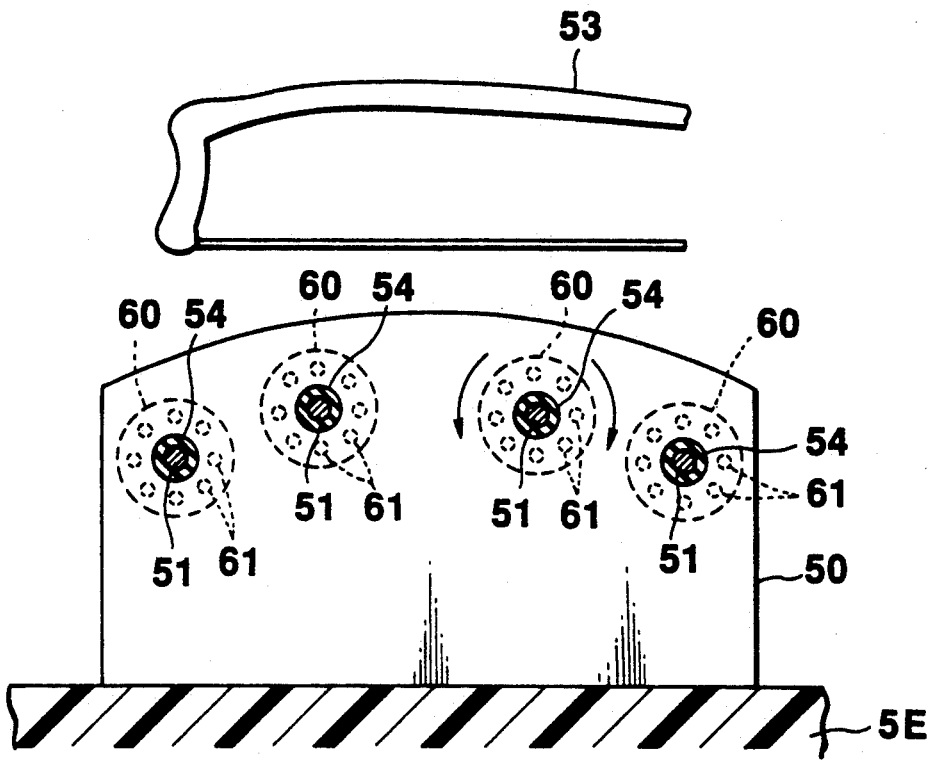
FIGS. 17A and 17B are views showing an bowing operation detection section and its neighborhood in a yet further embodiment of the invention.
Figure 17B:
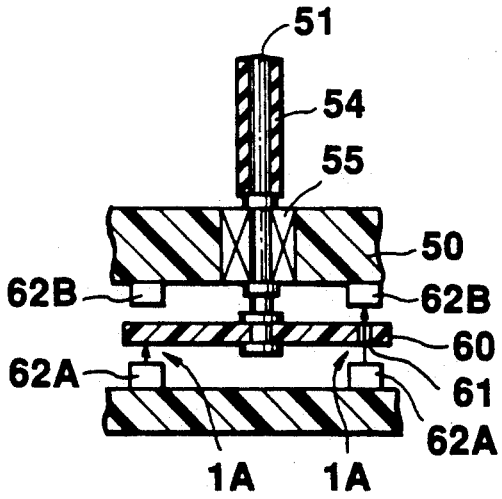
Figure 18:
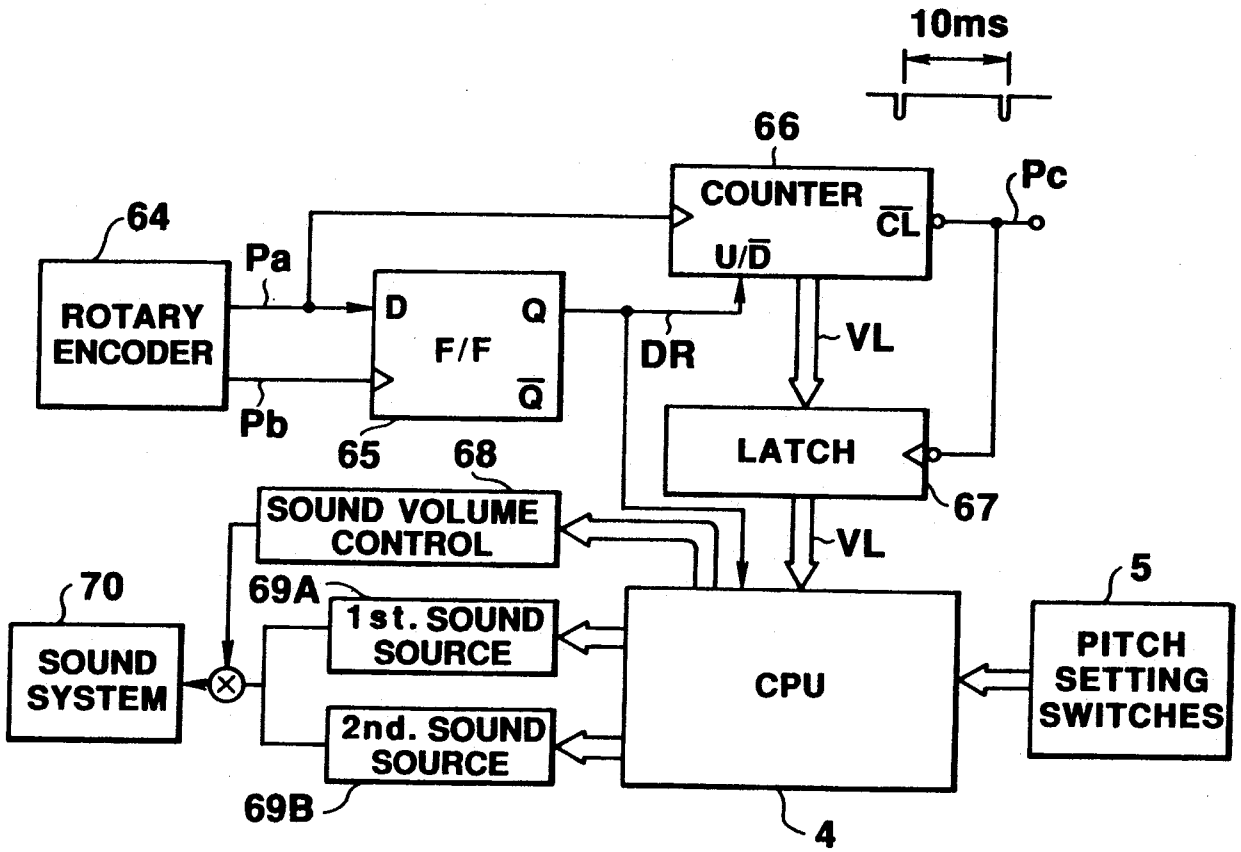
FIG. 18 is a block diagram of an overall circuit construction of the embodiment shown in FIGS. 17A and 17B.

In this embodiment, as shown in FIGS. 17A and 17B, the bowing operation detection section SK is composed of an optical sensor 1A having a rotary encoder 64 and characteristics (tone color, tone volume, effects) of a musical tone to be generated are controlled in accordance with the movement directions of the bowing operation 53. The other construction of the embodiment is the same as the above mentioned embodiment.

The electronic rubbed string instrument relating to the embodiment has a shape like a violin, similarly to the above described embodiment. Rotary shafts 51 are expanded between a pair of support plates 50 mounted on a instrument body 5E and both end portions of each rotary shaft 51 are rotatably supported by bearings 55 secured to the support plates 50. The rotary shafts 51 are coated with friction members 54. An orbicular plate 60 is secured on one end of each rotary shaft 51. There are formed a plurality of through holes 61 in the orbicular plate 61 at its portion close to the periphery and at given intervals. Two pairs of optical sensors 1A are disposed in opposition to the orbicular plate 61. The optical sensor 1A is composed of a light emission element 62A and a light receiving element 62B. The light emitted from the light emission element 62A is received by the light receiving element 62B through the through holes formed in the orbicular plate 60. The light emission elements 62A are secured on a fixing plate 63 mounted on the body 5E.

Figure 19:
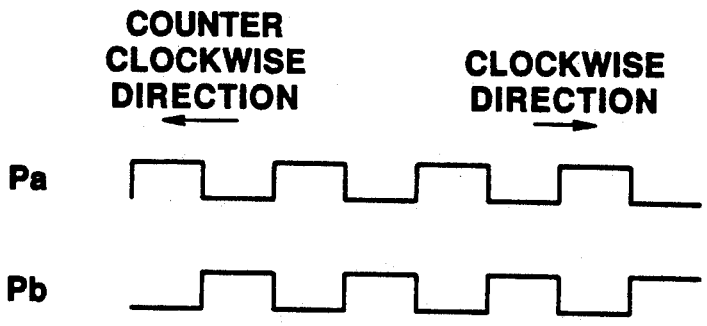
FIG. 19 is a view showing waveform characteristics of pulses Pa and Pb.
Figure 20:
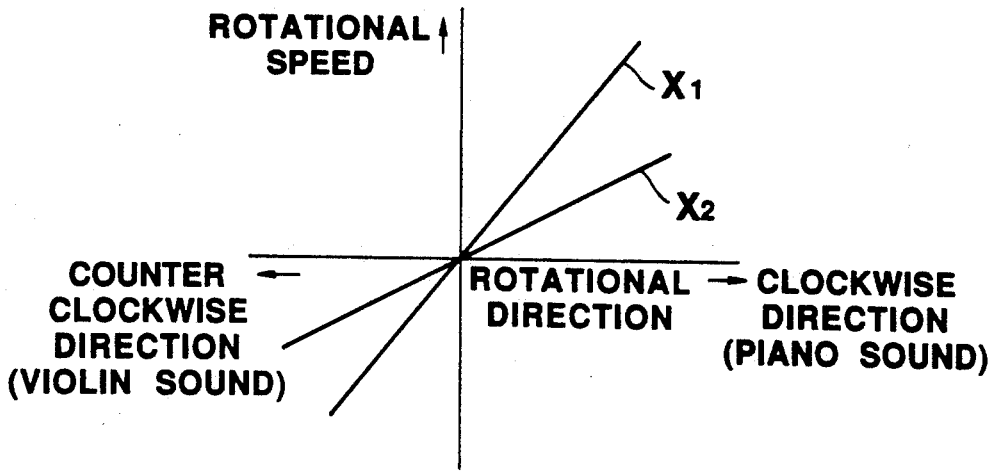
FIG. 20 is a view indicating rotational speed and rotational direction.

The light received by the light receiving element 62B of the optical sensor 1A is processed in a predetermined manner in the rotary encoder 64. As a result, the rotary encoder 64 generates pulse signals Pa, Pb having a rectangular waveform as shown in FIG. 19. These pulses Pa, Pb are obtained every time the orbicular plate 60 rotates by a predetermined rotational angle. The pulse signal Pa differs from the pulse signal Pb in phase by an angle of 90 deg. These pulse signals Pa, Pb are inverted in phase relationship, when the orbicular plate 60 (rotary shaft 51) rotates in a clockwise direction and when it rotates in a counter clockwise direction.

The pulse signal Pa is supplied to the D-input terminal of a flip-flop circuit 65 of a D-type for decoding and at the same time other pulse signal Pb is supplied to the clock input terminal of the same circuit 65. As a result, a direction signal DR is output from the Q-output terminal of the flip-flop circuit 65. The direction signal DR goes high, "H" level, when the orbicular plate 60 rotates in a clockwise direction and goes low, "L" level, when the orbicular plate 60 rotates in a counter clockwise direction. This direction signal DR serves to indicate the rotational direction of the orbicular plate 60 (rotary shaft 51).

The direction signal DR is supplied to a count-mode input terminal $U/\overline{D}$ of an up/down counter 66 and at the same time the pulse signal Pa is supplied to a count input terminal of the up/down counter 66. On the other hand, a pulse signal Pc which goes low, "L" level every predetermined time interval, for example, of 10 msec is supplied to the clear input terminal $\overline{CL}$ of the up/down counter 66. As a result, the up/down counter 66 up-counts number of pulses Pa in a unit time interval while the direction signal is high ("H" level) or down-counts number of pulses Pa in a unit time interval while the direction signal is low ("L" level). Therefore, the count value of the up/down counter 66 indicates a rotational speed of the orbicular plate 60 (rotary shaft 51).

The up/down counter 66 is connected to a latch circuit 67, to a control input terminal $\overline{L}$ of which pulse Pc is input. Accordingly, rotational speed data VL, i.e., the count value of the counter 66 just before the same counter 66 is cleared by receiving pulse Pc is latched at the latch circuit 67. The rotational speed data VL latched at the latch circuit 67 is supplied to CPU 4. The rotational speed data VL supplied to CPU 4 is further supplied to a sound volume control section 68. Sound volumes of respective musical tones generated by first and second sound sources 69A, 69B to be described later are controlled in accordance with the rotational speed data VL.

The direction signal DR supplied from the D-type flip-flop circuit 65 is supplied to CPU 4. Either of the first and second sound sources 69A, 69B is selected in accordance with the direction signal DR supplied to CPU 4. For example, in case of the direction signal indicating the clockwise direction, the first sound source 69A is selected and in case of the direction signal indicating the counter clockwise direction, the second sound source 69B is selected. The above first sound source 69A is arranged to generate musical tones having piano tone color and the second sound source 69B is arranged to generate musical tones having violin tone color. Musical tones generated by the first and second sound sources 69A, 698 are audibly output from the sound system 70.

In the construction mentioned above, when a bow 53 is actuated in a predetermined direction with the same bow being depressed onto the rotary shaft 51, the rotary encoder 64 having the optical sensor 1A generate two pulse signals Pa, Pb. Based on the pulse signals Pa, Pb, the flip-flop circuit 65 generates a direction signal DR indicating the rotational direction of the above rotary shaft 51. Since the direction signal DR is input to either of the first and second sound sources 69A, 69B, either of the first and second sound sources 69A, 69B is selected in accordance with the direction signal DR. On the basis of pulse Pa input from the rotary encoder 64 to the up/down counter 66, the up/down counter 66 generates rotational speed data VL, which is supplied through the latch circuit 67 to CPU 4. Therefore, the sound volume control section 68 is controlled in accordance with the rotational speed data VL. Then, sound volume level of a musical tone signal generated by either of the first and second sound sources 69A and 69B selected by the direction signal DR is controlled in accordance with a volume control signal from the sound volume control section 68. As a result, on the basis of the rotational direction in which the rotary shaft 51 is rotated by use of the bow 53, either of piano tone or violin tone can be selected. Further, on the basis of the rotational speed at which the rotary shaft 51 is rotated by use of the bow 53, sound volume level of a musical tone signal generated by either of the first and second sound sources 67A, 69B can be controlled.

In the embodiment, either of the first and second sound sources 69A, 69B is selected according to the direction in which the bow 53 is moved, and a musical tone having a specific tone color is selected. However, it is possible to control, in place of tone color and on the basis of the direction in which the bow 53 is moved, pitch characteristic, effect characteristics such as tremolo effect, delay effect and reverberation effect, sound volume characteristic and envelope effect.

Figure 22A:
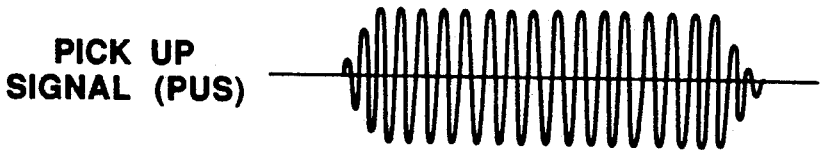
FIG. 22A is a view showing a waveform of a pick-up signal.
Figure 22B:
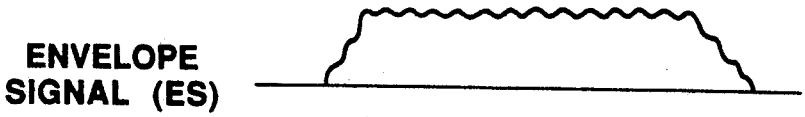
FIG. 22B is a view showing a waveform of an envelope signal.

Now, a further another embodiment of the invention will be described with reference to FIGS. 21, 22A and 22B.

Figure 21:
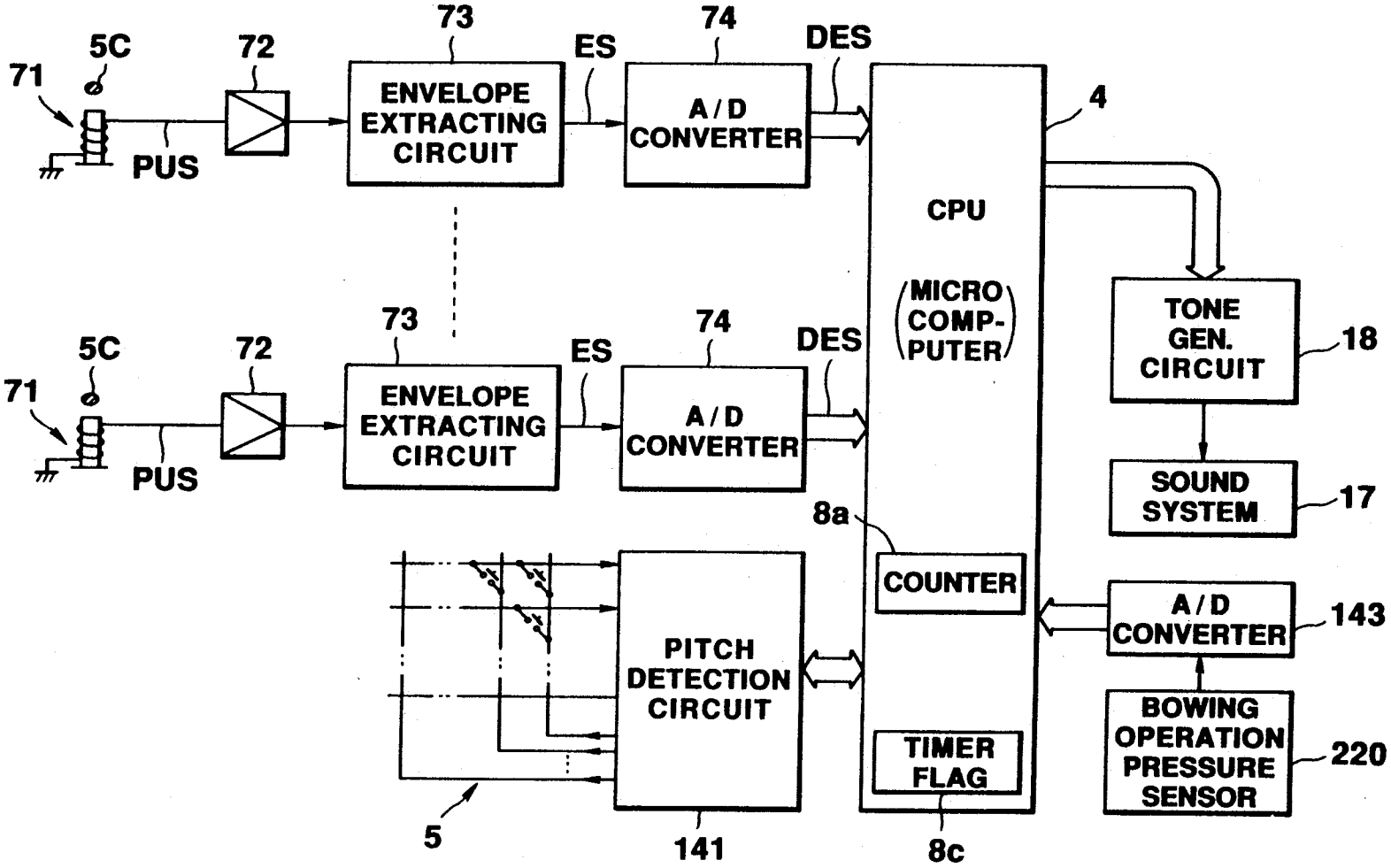
FIG. 21 is a view showing an overall circuit construction of a yet another embodiment of the invention.

FIG. 21 is a block diagram of the embodiment. This embodiment is different from the above mentioned embodiments in that characteristics of a musical tone are controlled on the basis of a pick-up signal detected by a pick-up device.

A vibration of a string 5C expanded over a musical instrument body (not shown) is converted into a corresponding pick-up signal PUS by a pick-up device such as an electro-magnetic type pick-up device, an optical type pick-up device and a piezo-electric type pick-up device. The converted pick-up signal PUS is amplified by an amplifier 72, the waveform of which signal is shown in FIG. 22A. The pick-up signal is supplied to an envelope extracting circuit 73. The envelope extracting circuit 73 extracts an envelope signal ES from the pick-up signal PUS as shown in FIG. 22B. It is preferable to use, as the envelope extracting circuit 73, the envelope extracting circuit which is disclosed in U.S. Pat. No. 4,781,097 assigned to the same assignee as the present patent application. The envelope signal ES supplied from the envelope signal ES is converted into a corresponding digital envelope signal DES by an A/D converter 73. Confirming that the level value of the digital envelope signal DES exceeds a predetermined set value (key-on level value), CPU 4 supplies a key-on signal to a tone generation circuit 18 for generation of a musical tone. On the basis of the key-on signal, the tone generation circuit 18 generates a musical tone, which is audibly output from the sound system 17. After generation of the musical tone, CPU 4 sequentially supplies the tone generation circuit 18 with signals indicating characteristics such as tone volume characteristic and tone color characteristic of musical tones to be generated in accordance with digital envelope signals DES sequentially detected by the envelope extracting circuit 73 and A/D converter 74. Therefore, tone color characteristic and tone volume characteristic of a musical tone being generated are controlled in accordance with the above digital envelope signal DES.

In the embodiment, when the value of the digital envelope signal DES exceeds a predetermined set value (key-on level value), generation of a musical tone starts responding thereto, and thereafter characteristics of a musical tone are controlled in accordance with digital envelope signals DES sequentially detected by the envelope extracting circuit 72, but this structure is by no means limitive. For example, the musical instrument according to the invention may be modified such that characteristics (tone volume characteristic and tone color characteristic) of a musical tone to be generated are designated in accordance with an output value of a digital envelope signal obtained when a predetermined time interval has lapsed after an output value of a digital envelope signal exceeded the key-on level value as in the former embodiment, and after generation of musical tone, characteristics of a musical tone to be generated are sequentially controlled in accordance with sequentially detected digital envelope signals (see FIGS. 2, 3 and 7).

It is possible to use the pick-up devices described in U.S. Pat. Nos. 2,933,967, 3,595,981, 3,691,285 and 4,765,219 as the above described electromagnetic type pick-up device. The pick-up device described in U.S. Pat. No. 4,723,468 may be used as the above mentioned piezoelectric pick-up device. Further the pick-up device described in U.S. Pat. No. 4,653,376 may be used as the above mentioned optical pick-up device.

What is claimed is:

1. An electronic rubbed-string instrument including an instrument body, comprising:

manually operable means which is adapted to be operated for a bowing operation by an instrument player;

bowing speed detection means for successively detecting bowing operation speeds of said manually operable means operated by the instrument player and for successively outputting digital bowing speed data representing the detected bowing operation speeds;

a plurality of bowing direction detection means mounted on the instrument body, and provided for a plurality of bowing operation receiving portions respectively for receiving bowing operations performed with said manually operable means by the instrument player, said plurality of bowing direction detection means being arranged for successively detecting directions in which the bowing operation of said manually operable means are performed and for successively outputting digital bowing direction data representing the detected bowing directions;

tone volume designation means for successively designating tone volume of a musical tone to be generated, in accordance with said digital bowing speed data successively outputted from said bowing speed detection means; and tone control means for successively controlling at least one of tone color, tremolo effect, reverberation effect, envelope effect, sound volume characteristic and tone pitch of a musical tone in accordance with the digital bowing direction data outputted from said plurality of bowing direction detection means, said musical tone having the tone volume designated by said tone volume designation means.

2. The instrument according to claim 1, wherein:

each of said plurality of bowing direction detection means includes a rotary encoder for generating pulse signals in response to the bowing operation, and means for judging the direction of the bowing operation based on the state of said pulse signals; and said bowing speed detection means includes a counter for counting said pulse signals for respective predetermined time intervals, the count result of which represents the bowing operation speeds of said manually operable means.

3. An electronic instrument including an instrument body, comprising:

manually operable means adapted to be operated for bowing operations by an instrument player;

a plurality of bowing direction detection means mounted on the instrument body and provided for respective portions for receiving the bowing operation of said manually operable means operated by the instrument player, said plurality of bowing direction detection means being arranged for successively detecting directions in which the owing operation of said manually operable means are performed by the instrument player, and for successively outputting digital bowing direction data representing the detected bowing directions; and tone control means for successively controlling at least one of tone color, tremolo effect, reverberation effect, envelope effect, sound volume characteristic and tone pitch of a musical tone in accordance with the digital bowing direction data outputted from said plurality of bowing direction detection means.

4. The instrument according to claim 3, wherein each of said plurality of bowing direction detection means includes:

a rotary encoder for generating pulse signals in response to the bowing operation; and means for judging the direction of the bowing operation based on the state of said pulse signals.

* * * * *

UNITED STATES PATENT AND TRADEMARK OFFICE

CERTIFICATE OF CORRECTION

PATENT NO. : 5,286,911

DATED : 15 February 1994

INVENTOR(S) : Yoshiyuki MURATA et al

It is certified that error appears in the above-identified patent and that said Letters Patent is hereby corrected as shown below:

Title page, Item: [30] Foreign Application Priority Data, line 1, 63-12331[U] should be --63-123314[U]--

Signed and Sealed this

Fourth Day of April, 1995

*Attest:*

*Attesting Officer*

Bruce Lehman

BRUCE LEHMAN

*Commissioner of Patents and Trademarks*